US006455220B1

(12) United States Patent
Cheng

(10) Patent No.: US 6,455,220 B1
(45) **Date of Patent: *Sep. 24, 2002**

(54) TONER PROCESSES

(75) Inventor: Chieh-Min Cheng, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/900,616

(22) Filed: Jul. 6, 2001

(51) Int. Cl.[7] ..... G03G 9/08
(52) U.S. Cl. ..... 430/137.14; 430/137.17
(58) Field of Search ..... 430/137.14, 137.17

(56) References Cited

U.S. PATENT DOCUMENTS

| | | | | |
|---|---|---|---|---|
| 3,674,736 | A | 7/1972 | Lerman et al. | 260/41 R |
| 4,137,188 | A | 1/1979 | Uetake et al. | 252/62.1 P |
| 4,558,108 | A | 12/1985 | Alexandru et al. | 526/340 |
| 4,797,339 | A | 1/1989 | Maruyama et al. | 430/109 |
| 4,983,488 | A | 1/1991 | Tan et al. | 430/137 |
| 4,996,127 | A | 2/1991 | Hasegawa et al. | 430/109 |
| 5,066,560 | A | 11/1991 | Tan et al. | 430/137 |
| 5,278,020 | A | 1/1994 | Grushkin et al. | 430/137 |
| 5,290,654 | A | 3/1994 | Sacripante et al. | 430/137 |
| 5,308,734 | A | 5/1994 | Sacripante et al. | 430/137 |
| 5,344,738 | A | 9/1994 | Kmiecik-Lawrynowicz et al. | 430/137 |
| 5,346,797 | A | 9/1994 | Kmiecik-Lawrynowicz et al. | 430/137 |
| 5,348,832 | A | 9/1994 | Sacripante et al. | 430/109 |
| 5,364,729 | A | 11/1994 | Kmiecik-Lawrynowicz et al. | 430/137 |
| 5,366,841 | A | 11/1994 | Patel et al. | 430/137 |
| 5,370,963 | A | 12/1994 | Patel et al. | 430/137 |
| 5,403,693 | A | 4/1995 | Patel et al. | 430/137 |
| 5,405,728 | A | 4/1995 | Hopper et al. | 430/137 |
| 5,418,108 | A | 5/1995 | Kmiecik-Lawrynowicz et al. | 430/137 |
| 5,496,676 | A | 3/1996 | Croucher et al. | 430/137 |
| 5,501,935 | A | 3/1996 | Patel et al. | 430/137 |
| 5,527,658 | A | 6/1996 | Hopper et al. | 430/137 |
| 5,561,025 | A | 10/1996 | Torres et al. | 430/137 |
| 5,585,215 | A | 12/1996 | Ong et al. | 430/107 |
| 5,650,255 | A | 7/1997 | Ng et al. | 430/137 |
| 5,650,256 | A | 7/1997 | Veregin et al. | 430/137 |
| 5,766,817 | A | 6/1998 | Cheng et al. | 430/137 |
| 5,766,818 | A | 6/1998 | Smith et al. | 430/137 |
| 5,944,650 | A | 8/1999 | Hu et al. | 416/57 |
| 6,309,787 | B1 * | 10/2001 | Cheng | 430/137 |

OTHER PUBLICATIONS

Copending Application Ser. No. 08/959,798, filed Oct. 29, 1997, on "Toner Processes", and published in Japan as Publication No. 1199817 on Jul. 27, 1999.
Copending Application Ser. No. 09/558,538, filed Apr. 26, 2000, on "Aggregation Processes".
Copending Application Ser. No. 09/557,830, filed Apr. 26, 2000, on "Toner Prcesses".

* cited by examiner

*Primary Examiner*—John Goodrow
(74) *Attorney, Agent, or Firm*—E. D. Palazzo

(57) ABSTRACT

A process for the preparation of toner which comprises (1) aggregating and coalescing in the presence of a coagulant an encapsulated colorant, and (2) blending with at least one toner.

30 Claims, No Drawings

TONER PROCESSES

PENDING APPLICATIONS AND PATENTS

In copending application U.S. Ser. No. 09/900,552, now U.S. Pat. No. 6,413,692 filed concurrently herewith, the disclosure of which is totally incorporated herein by reference, there is disclosed a process comprising coalescing a plurality of latex encapsulated colorants and wherein each of said encapsulated colorants are generated by miniemulsion polymerization.

Illustrated in U.S. Ser. No. 09/557,830, filed Apr. 26, 2000, now U.S. Pat. No. 6,346,358, the disclosure of which is totally incorporated herein by reference, is a process for the preparation of an encapsulated colorant comprising, for example, the emulsion polymerization of a miniemulsion of monomer, colorant, ionic surfactant, cosurfactant, and optional non ionic surfactant, and wherein the resulting encapsulated colorant containing a polymer shell is of a diameter of, for example, from about 100 to about 1,000 nanometers.

Illustrated in U.S. Ser. No. 09/558,538, filed Apr. 26, 2000, now U.S. Pat. No. 6,309,787, the disclosure of which is totally incorporated herein by reference, is a process comprising aggregating an encapsulated colorant with colorant particles, and wherein the encapsulated colorant is generated by a miniemulsion polymerization.

Illustrated in U.S. Ser. No. 08/959,798, filed Oct. 29, 1997, the disclosure of which is totally incorporated herein by reference, is a process for the preparation of toner comprising (i) aggregating a colorant dispersion containing a suitable surfactant with a latex emulsion containing an anionic surfactant, a nonionic surfactant, and a water miscible chain transfer agent, or a nonionic surfactant with chain transfer characteristics to form toner sized aggregates;

(ii) coalescing or fusing the aggregates; and optionally (iii) isolating, washing, and drying the resulting toner.

Illustrated in U.S. Pat. No. 5,944,650 and U.S. Pat. No. 5,766,818, the disclosures of each patent being totally incorporated herein by reference, are cleavable surfactants and the use thereof in emulsion/aggregation toner processes.

In U.S. Pat. No. 5,766,817, the disclosure of which is totally incorporated herein by reference, there is illustrated a process for the preparation of toner comprising (i) aggregating a colorant dispersion with a latex miniemulsion containing polymer, an ionic surfactant, a cosurfactant, and a nonionic surfactant;

(ii) coalescing or fusing the aggregates generated; and optionally (iii) cooling, isolating, washing, and drying the toner, and wherein the polymer in the miniemulsion is of a diameter of from about 50 to about 500 nanometers. The miniemulsion processes of this patent may be selected for the preparation of the encapsulated colorants of the present invention.

The appropriate components and process aspects of the above copending applications and patents may be selected for the present invention in embodiments thereof.

BACKGROUND OF THE INVENTION

The present invention is generally directed to toner processes, and more specifically, to processes which utilize aggregation and coalescence, or fusion of latexes, colorant, such as pigment, dye, or mixtures thereof, and optional additive particles. In embodiments, the present invention is directed to processes which provide custom color toner compositions with, for example, a volume average diameter of from about 1 micron to about 25 microns, and more specifically, from about 2 microns to about 12 microns, and a narrow particle size distribution of, for example, about 1.10 to about 1.45 as measured by the Coulter Counter method. The resulting custom color toners can be selected for known electrophotographic imaging and printing processes, including digital color processes.

The present invention in aspects thereof is directed to a process for the preparation of custom toners by mixing a number of polymer encapsulated colorant latex particles, and more specifically, by blending and aggregating a number, such as four, different colorant polymer encapsulated miniemulsion latexes, and wherein each of the miniemulsion latex emulsions is comprised of monomer particles, more specifically submicron in size of from, for example, about 100 nanometers to about 1,000 nanometers, and more specifically, from about 200 nanometers to about 600 nanometers in volume average diameter, a nonionic surfactant and an ionic surfactant of opposite charge polarity to that of the ionic surfactant in the colorant dispersion, heating to accomplish polymerization of the monomer, thereafter heating the resulting mixture at, for example, below about the polymer glass transition temperature, and more specifically, from about 35° C. to about 60° C. (Centigrade) to form toner sized aggregates of from about 2 microns to about 25 microns in volume average diameter, and which toner is comprised of polymer, colorants, and optional additive particles, followed by heating the aggregate suspension above about the resin, or polymer glass transition temperature, and more specifically, at, for example, from about 70° C. to about 100° C. to effect coalescence or fusion of the components of the aggregates and to form mechanically stable integral custom toner particles. Each miniemulsion can contain, for example, a latex of water, polymer or resin, and colorant, oil, or monomer, water, surfactants, and more specifically, a cosurfactant, such as an alcohol, an alkane, an ether, an alcohol ester, an amine, a halide, or a carboxylic acid ester, which cosurfactant is more specifically inert, nonvolatile, water insoluble, and is a liquid at a temperature of, for example, from about 40° C. to about 90° C., and contains a terminal aliphatic hydrocarbyl group with at least about 10 carbon atoms, and more specifically, from about 12 to about 24 carbon atoms, and mixtures thereof, and more specifically, an aliphatic alcohol with at least about 8 carbon atoms, such as from about 10 to about 25 carbon atoms, and an alkane with from about 10 to about 30 carbon atoms. The cosurfactant primarily functions to reduce the diffusion of monomer out of the monomer droplet and enables relatively stable miniemulsions since, it is believed, there is formed intermolecular complexes at the oil/water interface. The complexes are believed to be liquid condensed and electrically charged thus creating a low, for example from about 0.5 dyne/centimeter to about 5 dyne/centimeter interfacial tension and high resistance to droplet coalescence.

With the present invention in embodiments, there is selected colorant encapsulated latexes containing a polymer generated by miniemulsion polymerization process. Aggregation/coalescence of the colorant encapsulated polymer latexes permit, for example, the generation of a wide range of colored toner compositions with, for example, high colorant loading, narrow particle size distribution, and excellent projection efficiency.

Other advantages in embodiments include, for example, (1) excellent particle dispersion in the resin matrix; (2)

acceptable mechanical properties; (3) protection of the colorant from outside influences during toner processing; (4) protection of the matrix or toner resin from interaction with the colorant; and (5) the generation of custom color toners with uniform triboelectric charging characteristics independent of the colorant present and wherein the colorant is passivated. When the xerographic properties, such as triboelectric charge (tribo), admix, developer stability, humidity sensitivity, and the like of highlight color and black toners, are substantially equivalent, the toners can be considered triboelectrically passivated. One primary main advantage of a blended mixture of two passivated toners is their interchangeability.

Embodiments of the present invention are directed to processes for the preparation of toners, and more specifically, highlight color toners and custom color toners. A highlight color toner can be a single toner of a single color of, for example, a saturated hue, which can be utilized with a second color toner like a black toner. These colored toners may be imaged on documents with twin engine xerographic copiers or printers, where each engine comprises a separate charging, exposure, development, transfer, and cleaning component, one for each color toner, or with a single engine xerographic copier or printer which utilize two separate development stations, one for each color, and where the paper, transparency, or other throughput substrate makes either one or two cycles. An example of a single engine printing/copying device with only one cycle can be referred to as trilevel xerography. Applications for highlight color include, for example, emphasizing important information, headlining titles in documents, slides, overhead transparencies, figures and the like. The image color density of a highlight color may be controlled by the developed toner mass per unit area, for example, the higher the toner mass per unit area, the darker the color. Typical highlight colors are common colors desired by many different types of customers, such as red, blue, brown, green, and the like, and wherein a custom color toner can be a very specific highlight color toner. Often toners with these colors are used for corporate logos, letterhead, government flags, or official document seals, where the color coordinates are specified. Examples of custom colors are Xerox Corporation Blue®, IBM Blue®, Blue CrossBlue®, and the like. Other custom colors may include gold, silver, fluorescent colors, and the like.

The aforementioned toners are especially useful for imaging processes, especially xerographic processes, which usually enable high toner transfer efficiency, such as those having a compact machine design without a cleaner, or those that are designed to provide high quality colored images with excellent image resolution, improved signal-to-noise ratio, and image uniformity.

PRIOR ART

There is illustrated in U.S. Pat. No. 4,996,127, the disclosure of which is totally incoporated herein by reference, a toner of associated particles of secondary particles comprising primary particles of a polymer having acidic, or basic polar groups and a coloring agent. The polymers selected for the toners of the '127 patent can be prepared by an emulsion polymerization method, see for example columns 4 and 5 of this patent. In column 7 of this '127 patent, it is indicated that the toner can be prepared by mixing coloring agent and optional charge additive with an emulsion of the polymer having an acidic or basic polar group obtained by emulsion polymerization. In U.S. Pat. No. 4,983,488, the disclosure of which is totally incoporated herein by reference, there is disclosed a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation possess diameters suitable for a toner. It is indicated in column 9 of this patent that coagulated particles of 1 to 100, and particularly 3 to 70, are obtained. In U.S. Pat. No. 4,797,339, the disclosure of which is totally incoporated herein by reference, there is disclosed a process for the preparation of toners by resin emulsion polymerization, wherein similar to the '127 patent certain polar resins are selected. In U.S. Pat. No. 4,558,108, the disclosure of which is totally incoporated herein by reference, there is disclosed a process for the preparation of a copolymer of styrene and butadiene by specific suspension polymerization.

In U.S. Pat. No. 5,561,025, the disclosure of which is totally incorporated herein by reference, there are illustrated emulsion/aggregation/coalescence processes wherein water phase termination agents, that is chain transfer agents that are not water miscible are selected.

Other prior art that may be of interest includes U.S. Pat. Nos. 3,674,736; 4,137,188 and 5,066,560, the disclosures of which are totally incorporated herein by reference.

Emulsion/aggregation processes for the preparation of toners are illustrated in a number of Xerox patents, the disclosures of each of which are totally incorporated herein by reference, such as U.S. Pat. No. 5,290,654, U.S. Pat. No. 5,278,020, U.S. Pat. No. 5,308,734, U.S. Pat. No. 5,370,963, U.S. Pat. No. 5,344,738, U.S. Pat. No. 5,403,693, U.S. Pat. No. 5,418,108, U.S. Pat. No. 5,364,729, and U.S. Pat. No. 5,346,797; and also of interest may be U.S. Pat. Nos. 5,348,832; 5,405,728; 5,366,841; 5,496,676; 5,527,658; 5,585,215; 5,650,255; and 5,650,256. The appropriate components and processes of these patents may be selected for the processes of the present invention in embodiments thereof.

Processes for the preparation of spherical toners at coalescence temperatures of from about 100° C. to about 120° C. are illustrated in U.S. Pat. No. 5,501,935, the disclosure of which is totally incorporated herein by reference.

SUMMARY OF THE INVENTION

It is a feature of the present invention to provide toner processes with many of the advantages illustrated herein.

In another feature of the present invention there are provided simple and economical processes for the preparation of custom colored toner compositions with excellent colorant, especially pigment dispersions, thus enabling the achievement of excellent color print quality, and wherein there is selected a number, for example from about 2 to about 10, of polymer encapsulated latex colorants.

A further feature of the present invention is to provide a toner with high projection efficiency, such as from about 80 to about 95, and more specifically from about 85 to about 95 percent efficiency as measured by the Match Scan II spectrophotometer available from Milton-Roy, and for use in transparencies.

In another feature of the present invention there are provided emulsion aggregated toners with excellent high intensity color resolutions, and which toners possess high light transmission allowing about 80 to 95 percent of the transmitted light passing through a fused image on a transparency to reach the screen from an overhead projector.

Also, in a further feature of the present invention there is provided a process for the preparation of custom toner compositions with a volume average diameter of from about 1 to about 20 microns, and more specifically from about 2 to about 12 microns, and a particle size distribution of about 1.10 to about 1.35, and more specifically from about 1.15 to about 1.25 as measured by a Coulter Counter without the need to resort to conventional classifications to narrow the toner particle size distribution, and wherein there are selected encapsulated colorants.

Moreover, in another feature of the present invention there are provided simple and economical processes for the direct preparation of a wide range of custom colored toner compositions with, for example, excellent projection efficiency and narrow GSD.

Moreover, in a further feature of the present invention there is provided a process for the preparation of toners which after fixing to paper substrates result in images with gloss values of from about 20 Gardner Gloss Units (GGU) to about 70 GGU as measured by Gardner Gloss meter matching of toner and paper.

In a further feature of the present invention there is provided a process for the preparation of custom color toner by aggregation and coalescence, or fusion (aggregation/coalescence) of latex, colorants, and additive particles, and wherein the latex is a miniemulsion, and there is included therein colorant, a cosurfactant, or a hydrotrope (small water soluble molecules with minimum surface activity), such as sodium xylene sulfonate or sodium toluene sulfonate, which can be selected to enhance latex polymer stability and reduce the amount of undesirable sediment, and wherein there results an encapsulated colorant dispersion that can be aggregated with colorant particles.

In yet another feature of the present invention there are provided custom colored toner compositions with low fusing temperatures of from about 120° C. to about 180° C., and which toner compositions exhibit excellent blocking characteristics at and above about 45° C., and wherein there are selected encapsulated colorants.

It is also a feature of the present invention to provide a process for obtaining highlight or custom color toner compositions which comprises admixing at least two toners generated from colorant encapsulated latexes.

Other features of the present invention include retaining during blending the polymer particle size wherein the blended toners are of the same image resolution as the toners in the primary toner set, and avoiding or minimizing agglomeration of blended toner pigments with each other. Since the toners are isolated as separate toner particles in the primary set of toners thus permitting the blending of small batches of highlight or custom color toners from the primary toner set at low cost. Other advantages of the present invention in embodiments include expanding the range and number of economically feasible highlight or custom color toners; the minimization of toner inventory costs since only the primary blendable toners may need to be stored; the provision of security toners, for example, by including an IR absorbing primary toner in the toner blend; maintaining a primary set of blendable toners for pictorial color toners, highlight and custom color toners, for example a primary set of three color toners (cyan, magenta, and yellow) plus black could be used for pictorial color printing and copying, a highlight set of blended red, blue, brown, and green toners; and the addition of white, unpigmented, fluorescent, metallic, silver, gold or metallic toners to the primary toner set to further increase the range of potential highlight and custom colors available by blending colorant encapsulated passivated toners.

These and other features of the present invention are accomplished in embodiments by the provision of toners and processes thereof. In embodiments of the present invention, there are provided sediment free, or substantially sediment free processes for the preparation of toner compositions by the aggregation/coalescence of latex, colorant and encapsulated colorant, such as pigment particles in the presence of a cosurfactant, and wherein the temperature of the aggregation may be selected to control the aggregate size, and thus the final toner particle size, and the coalescence temperature and time may be utilized to control the toner shape and surface properties, and thereafter blending and mixing can be accomplished utilizing a high shearing device, such as a Brinkman Polytron or IKA homogenizer, at a speed of, for example, from about 3,000 revolutions per minute to about 10,000 revolutions per minute for a duration of, for example, from about 1 minute to about 120 minutes wherein the mixing temperature is from about 20° C. to about 5° C. below the glass transition temperature of the resin, wherein the temperature below the glass transition temperature is from about 25° C. to about 60° C., or wherein the coagulant or ionic surfactant is a cationic surfactant, such as dialkylbenzene dialkylammonium chloride like SANIZOL B-50™ available from Kao, or MIRAPOL™ available from Alkaril Chemicals, thereby causing a flocculation or coagulation of the colorant, such as pigment encapsulated latexes, which coagulant can be selected in various effective amounts, such as for example from about 0.1 to about 5 percent, and more specifically from about 0.1 and 2 percent by weight of water; wherein the amount of pigment encapsulated latexes present is from about 1 to about 50 percent, and more specifically, from about 5 and 25 percent by weight of the total dispersion comprising pigment encapsulated latexes and water; wherein the amount of water is from about 50 to about 99 percent, and more specifically, from about 75 and 95 percent by weight of the total dispersion comprising pigment encapsulated latexes and water. Thus, for example, a green custom color toner can be prepared by mixing yellow and cyan pigment encapsulated latexes wherein the yellow pigment encapsulated latex is present in an amount of from, for example, (throughout "for example" is intended for all ranges) about 40 to about 60 weight percent, and the cyan pigment encapsulated latex is present in an amount of from about 60 to about 40 weight percent based on the total pigment encapsulated latex mixture; an orange custom color toner can be prepared by mixing yellow and magenta pigment encapsulated latexes wherein the yellow pigment encapsulated latex is present in an amount of from about 60 to about 75 weight percent, and the magenta pigment encapsulated latex is present in an amount of from about 40 to about 25 weight percent based on the total pigment encapsulated latex mixture; a red custom color toner can be prepared by mixing yellow and magenta pigment encapsulated latexes wherein the yellow pigment encapsulated latex is present in an amount of from about 35 to about 50 weight percent, and the magenta pigment encapsulated latex is present in an amount of from about 65 to about 50 weight percent based on the total pigment encapsulated latex mixture; a violet custom color toner prepared by mixing cyan and magenta pigment encapsulated latexes wherein the cyan pigment encapsulated latex is present in an amount of from about 55 to about 75 weight percent, and the magenta pigment encapsulated latex is present in an amount of from about 45 to about 25 weight percent, based on the total pigment encapsulated latex mixture; a purple custom color toner prepared by mixing cyan and magenta pigment encapsulated latexes wherein the cyan pigment encapsulated latex is present in an amount of from about 25 to about 40 weight percent, and the magenta pigment encapsulated latex is present in an amount of from about 75 to about 60 weight percent, based on the total pigment encapsulated latex mixture; a brown custom color toner prepared by mixing yellow, magenta and black pigment encapsulated latexes wherein the yellow pigment encapsulated latex is present in an amount of from about 55 to about 75 weight percent, the magenta pigment encapsulated latex is present in an amount of from about 20 to about 30 weight percent, and the black pigment encapsulated latex is present in an amount of from about 5 to about 15 weight percent based on the total pigment encapsulated latex mixture; a lime green custom color toner prepared by mixing yellow, cyan and magenta pigment encapsulated latexes wherein the yellow pigment encapsulated latex is present in an amount of from about 25 to about 40 weight percent, the cyan pigment encapsulated latex is present in an amount of from about 25 to about 40 weight percent, and the magenta pigment encapsulated latex is present in an amount of from about 25 to about 40 weight percent, based on the total pigment encapsulated latex mixture, or there may be mixed a number, such as four, of encapsulated latexes, and wherein each of the latexes contains a polymer shell and a core of a dissimilar colorant, such as black, green, yellow, cyan, magenta, brown, blue, and the like.

Aspects of the present invention relate to a process for the preparation of toner which comprises (1) aggregating and coalescing in the presence of a coagulant an encapsulated colorant, and (2) blending with at least one toner; a process which comprises mixing, aggregating and coalescing an encapsulated colorant in the presence of a coagulant; separately repeating the mixing, aggregating and coalescing, and thereafter blending each of the toners obtained, and wherein the encapsulated colorant is comprised of colorant and polymer; a process comprising aggregating latexes of polymer encapsulated colorants, and wherein each of the encapsulated colorants are generated by a miniemulsion polymerization; a process wherein the encapsulated colorants are generated by the emulsion polymerization of a colorant and a monomer, wherein a miniemulsion of the monomer is generated, and wherein the miniemulsion contains subsequent to polymerization a colorant core and a polymer shell, and which miniemulsion is generated in the presence of an ionic surfactant, a cosurfactant, and a nonionic surfactant, and wherein the monomer in the miniemulsion is of a diameter of from about 100 to about 1,000 nanometers; and wherein the colorant is encapsulated in the polymer generated by the polymerization; a process wherein the aggregating is accomplished below about the polymer glass transition temperature followed by coalescing, and wherein the coalescing or fusing of the aggregates is accomplished above about the polymer glass transition temperature, and wherein the polymer diameter is from about 200 to about 575 nanometers, and there results a toner with a size of from about 2 to about 30 microns in volume average diameter; a process wherein the temperature below the glass transition temperature is from about 25° C. to about 55° C., and the heating above the glass transition temperature is from about 60° C. to about 100° C.; a process wherein the temperature below the polymer glass transition temperature is from about 35° C. to about 55° C., and the temperature above the polymer glass transition temperature is from about 70° C. to about 90° C.; a process wherein the temperature at which the aggregation is accomplished controls the size of the aggregates, and wherein the final toner size is from about 2 to about 10 microns in volume average diameter, and wherein the temperature and time of the coalescence or fusion of the components of aggregates control the shape of the resultant toner; a process wherein the aggregation temperature is from about 20° C. to about 55° C., and wherein the coalescence or fusion temperature is from about 85° C. to about 95° C.; a process wherein the cosurfactant is an alkane with from about 10 to about 24 carbon atoms, and wherein the alkane is present in an amount of from about 0.05 to about 5 parts, or percent by weight; a process wherein the cosurfactant is an alcohol, or an alkyl thiol; a process wherein the alcohol contains from about 8 to about 20 carbon atoms; a process wherein the alcohol is decanol, lauryl alcohol, tetradecanol, cetyl alcohol, stearyl alcohol, or octadecanol; a process wherein the alcohol is present in an amount of from about 0.1 to about 5 parts, or weight percent; a process wherein the alkane is n-decane, dodecane, tetradecane, hexadecane, octadecane octyne, dodecyl cyclohexane, or hexadecyl benzene; a process wherein the colorant is a pigment, and wherein the pigment dispersion contains an ionic surfactant, and the miniemulsion is a latex containing a nonionic surfactant and an ionic surfactant of opposite charge polarity to that of the ionic surfactant present in a pigment dispersion, and wherein the colorant particles are comprised of pigment particles; a process wherein the surfactant utilized in the colorant dispersion is a cationic surfactant, and the ionic surfactant present in the latex mixture is an anionic surfactant; a process wherein the aggregation is accomplished at a temperature of from about 35° C. to about 1° C. below the Tg of the latex polymer, or latex resin for a duration of from about 0.5 hour to about 5 hours; a process wherein the coalescence or fusion of the components of aggregates for the formation of integral toner particles comprised of encapsulated colorants is accomplished at a temperature of about 85° C. to about 105° C. for a duration of from about 1 hour to about 5 hours; a process wherein the polymer shell or coating is selected from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(alkyl methacrylate-2-carboxyethyl acrylate), poly(styrene-alkyl acrylate-2-carboxyethyl acrylate), poly(styrene-alkyl acrylate-acrylonitrile-2-carboxyethyl acrylate), poly(styrene-1,3-diene-acrylonitrile-2-carboxyethyl acrylate), poly(alkyl acrylate-acrylonitrile-2-carboxyethyl acrylate); and other similar polymers; and wherein the polymer is optionally present in an amount of from about 35 percent by weight to about 99 percent by weight of toner; a process wherein the miniemulsion monomer is a latex, and wherein subsequent to polymerization by heating there results a polymer selected from the group consisting of poly(styrene-butadiene), poly(methylstyrene-butadiene), poly(methyl methacrylate-butadiene) poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly (methyl acrylate-isoprene), poly(ethyl acrylate-isoprene), poly(propyl acrylate-isoprene), and poly (butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly (styrene-butyl acrylate-acrylononitrile-acrylic acid), poly(styrene-butadiene-2-carboxyethyl acrylate), poly (styrenebutadiene-acrylonitrile-2-carboxyethyl acrylate), poly(styrene-butyl acrylate-2-carboxyethyl acrylate), and poly(styrene-butyl acrylate-acrylononitrile-2-carboxyethyl acrylate); a process wherein the ionic surfactant is an anionic surfactant selected from the group consisting of sodium dodecyl sulfate, sodium dodecylbenzene sulfate, sodium dodecylnaphthalene sulfate, and sodium tetrapropyl diphenyloxide disulfonate, and wherein the colorant core is a dispersion containing a cationic surfactant of a quaternary ammonium salt; a process wherein the encapsulated colorant is carbon black, magnetite, cyan, yellow, magenta, or mixtures thereof; a process wherein the toner particles isolated are from about 2 to about 15 microns in volume average diameter, and the particle size distribution (GSD) thereof is from about 1.15 to about 1.30, wherein each of the surfactants utilized represents from about 0.01 to about 5 weight percent of the total reaction mixture, and wherein there is added to the surface of the formed toner metal salts, metal salts of fatty acids, silicas, metal oxides, or mixtures thereof, each in an amount of from about 0.1 to about 10 weight percent of the obtained toner particles; a process wherein the monomer in the miniemulsion is of a diameter of from about 200 to about 600 nanometers; a process for the preparation of custom color toner which comprises aggregating a number of latex encapsulated colorants containing water, a polymer shell, an ionic surfactant, a cosurfactant, and a nonionic surfactant; coalescing the aggregates generated; and optionally isolating, washing, and drying the toner; a process wherein the isolating washing and drying are accomplished; a process wherein the alkyl thiol selected contains from about 10 to about 18 carbon atoms; a process wherein the alkyl thiol is decanethiol, 1-dodecanethiol, t-dodecanethiol, octadecanethiol, and the like; a process wherein the polymer formed by polymerization of the monomer present in the minimization is poly(styrene-alkyl acrylate-acrylic acid), poly(styrene-1,3-diene-acrylic acid), or poly(styrene-alkyl acrylate-2-carboxyethyl acrylate); a process wherein the polymer is poly (styrene-butyl acrylate-acrylic acid), poly(styrene-butyl acrylate-2-carboxyethyl acrylate), or poly (styrene-butadiene-acrylic acid); a process wherein the cosurfactant is selected from the group consisting of alkanes, hydrocarbyl alcohols, ethers, alkyl thiols, amines, halides, esters, and the like; a process wherein the latex encapsulated colorants are dissimilar; a process comprising aggregating separately prepared encapsulated colorants wherein each colorant is dissimilar and wherein each of the encapsulated colorants are generated by a miniemulsion polymerization, and wherein the polymerization is accomplished in the presence of a cosurfactant; a process wherein the cosurfactant is present in an amount of from about 0.1 to about 10 weight percent; a process wherein the cosurfactant is present in an amount of from about 1 to about 3 weight percent; a process comprising the separate forming of latex emulsions containing a monomer and colorant, polymerizing resulting in an encapsulated colorants, and mixing the encapsulated colorants; a process wherein the latex contains water; a process wherein each of the latex encapsulated colorants are comprised of water, a colorant core and a polymer coating; a process for the preparation of individual colorant encapsulated, completely or about 95 to 100 percent, or incompletely, with polymer comprising the polymerization of monomer in the presence of chain transfer agent, initiators, and colorant, and thereafter mixing the encapsulated colorant with colorant particles.

The colorant encapsulated latex polymer can be prepared by a free radical-initiated aqueous miniemulsion polymerization of a mixture of from about 1 to about 10 monomers, and more specifically from about 2 to about 5 monomers, such as olefinic monomers, free radical initiator, chain transfer agent, surfactant, cosurfactant, and water, wherein the amount of monomers selected is, for example, from about 1 to about 40 weight percent, and the amount of water is from about 59 to about 98 weight percent, based on the total reaction mixture amount; heating at, for example, a temperature of about 45° C. to about 90° C., wherein the resulting latex polymer possesses, for example, a number average molecular weight of from about 1,000 grams per mole to about 200,000 grams per mole, and a weight average molecular weight of from about 5,000 grams per mole to about 500,000 grams per mole, and a glass temperature of from 40° C. to about 120° C. The colorants selected may be present in various effective amounts, such as from about 1 to about 25, and more specifically from about 2 to about 14 weight percent based on the total monomer or monomers used to prepare the polymer resin. The free radical initiator is selected in amounts of, for example, from about 0.1 to about 10 weight percent based on the total monomer or monomers used to prepare the polymer resin. Chain transfer agents are selected in amounts of from about 0.5 to about 10 weight percent based on the total monomer or monomers selected to prepare the polymer resin. Surfactants are selected in amounts of from about 0.1 to about 10 weight percent based on the total monomer or monomers selected to prepare the polymer resin. Cosurfactant, when present, is selected in various suitable amounts, such as, for example, from about 0.005 to about 5, and more specifically from about 0.5 to about 3 weight percent, based on the total monomer or monomers used to prepare the polymer resin. The latex polymer emulsion is more specifically comprised of from about 1 to about 40 weight percent of polymer particles, of an average diameter of from about 100 nanometers to about 1,000 nanometers, as measured by light scattering technique on a Coulter N4 Plus Particle Sizer.

With the present invention in embodiments, there are selected individual separate latex colorants encapsulated by a polymer more specifically generated by a semicontinuous, miniemulsion polymerization process, followed by aggregation/coalescence of the colorant encapsulated polymers to enable custom color toners with at least four different colors of cyan, yellow, magenta, and black with uniform tribocharging wherein the difference in tribocharging among the different four color toners is, for example, less than about 10 $\mu$C/gram, and more specifically less than about 5 $\mu$C/gram, such as from about 1 to about 5.

Further embodiments of the present invention include a process for the preparation of custom color toner comprising (i) aggregating a number, such as four individual and separate latex polymer encapsulated primary colorants or primary colorant encapsulated polymer miniemulsions containing dissimilar colorants such as yellow, cyan magenta, and black, water, polymer, an ionic surfactant, a cosurfactant, and a nonionic surfactant, with a colorant dispersion;

(ii) coalescing or fusing the aggregates generated; and (iii) cooling, isolating, washing, and drying the toner, and wherein themonomer in the miniemulsion is of a diameter of from about 100 to about 1,000 nanometers; a process wherein the aggregating is below about the polymer shell glass transition temperature present in the colorant encapsulated latex emulsions, the coalescing or fusing is above about the polymer glass transition temperature, and wherein each of the colorant encapsulated polymer particle diameter is from about 200 to about 600 nanometers, and there results a custom color toner with a size of from about 2 to about 20 microns in volume average diameter; wherein the temperature below the polymer glass transition temperature is from about 25° C. to about 55° C., and the heating above the glass transition temperature is from about 60° C. to about 100° C.; a process wherein the temperature below the polymer glass transition temperature is from about 35° C. to about 60° C., and the heating above the glass transition temperature is from about 65° C. to about 95° C.; a process wherein the temperature at which the aggregation is accomplished controls the size of the aggregates, and wherein the final toner size is from about 2 to about 12 microns in volume average diameter, and wherein the temperature and time of the coalescence or fusion of the components of aggregates control the shape, such as spherical, of the resultant toner; a process wherein the aggregation temperature is from about 20° C. to about 55° C., and wherein the coalescence or fusion temperature is from about 75° C. to about 97° C.; a process wherein the colorant is a pigment or a dye, and wherein the pigment or a dye dispersion contains an ionic surfactant, and the minilatex emulsion contains a nonionic surfactant and an ionic surfactant of opposite charge polarity to that of ionic surfactant present in the pigment or dye dispersion; a process wherein the surfactant utilized in the colorant dispersion is a cationic surfactant, and the ionic surfactant present in the latex mixture is an anionic surfactant; a process wherein the aggregation is accomplished at a temperature of from about 15° C. to about 1° C. below the Tg of the latex polymer, or latex resin for a duration of from about 0.5 hour to about 4 hours; a process wherein the coalescence or fusion of the components of aggregates for the formation of integral toner particles comprised of colorant, resin and optional known toner additives is accomplished at a temperature of about 85° C. to about 105° C. for a duration of from about 1 hour to about 5 hours; a process wherein there is formed from the latex monomer a polymer selected, for example, from the group consisting of poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(styrene-alkyl acrylate-2-carboxyethyl acrylate), poly(styrene-1,3-diene-2-carboxyethyl acrylate), poly(styrene-alkyl methacrylate-2-carboxyethyl acrylate), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(alkyl methacrylate-2-carboxyethyl acrylate), poly(styrene-alkyl acrylate-acrylonitrile-2-carboxyethyl acrylate), poly(styrene-1,3-diene-acrylonitrile-2-carboxyethyl acrylate), and poly(alkyl acrylate-acrylonitrile-2-carboxyethyl acrylate), and wherein the polymer is present in an amount of from about 35 percent by weight to about 99 percent by weight of toner, and wherein the colorant is a pigment; a process wherein the polymer shell formed by polymerization of the latex monomer is selected from the group consisting of poly(styrene-butadiene), poly(methylstyrene-butadiene), poly(methyl methacrylate-butadiene), poly (ethyl methacrylate-butadiene), poly(propyl methacrylate-butadiene), poly(butyl methacrylate-butadiene), poly(methyl acrylate-butadiene), poly (ethyl acrylate-butadiene), poly(propyl acrylate-butadiene), poly(butyl acrylate-butadiene), poly (styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly (methyl acrylate-isoprene), poly(ethyl acrylate-isoprene), poly(propyl acrylate-isoprene), and poly (butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly (styrene-butyl acrylate-acrylononitrile-acrylic acid), poly(styrene-butadiene-2-carboxyethyl acrylate), poly (styrene-butadiene-acrylonitrile-2-carboxyethyl acrylate), poly(styrene-butyl acrylate-2-carboxyethyl acrylate), poly(styrene-butyl acrylate-acrylononitrile-2-carboxyethyl acrylate), and the like, and wherein the polymer is present in an amount of from 65 percent by weight to about 95 percent by weight of toner, and wherein the colorant is a pigment; a process wherein the anionic surfactant is selected from the group consisting of sodium dodecyl sulfate, sodium dodecylbenzene sulfate, sodium dodecylnaphthalene sulfate, and sodium. tetrapropyl diphenyloxide disulfonate, and wherein the colorant dispersion contains a cationic surfactant; a process wherein the colorant is carbon black, magnetite, cyan, yellow, magenta, and mixtures thereof; a process wherein the toner particles isolated are from about 2 to about 15 microns in volume average diameter, and the particle size distribution thereof is from about 1.15 to about 1.30, wherein each of the surfactants utilized represents from about 0.01 to about 10 weight percent of the total reaction mixture, and wherein there is added to the surface of the formed toner metal salts, metal salts of fatty acids, silicas, metal oxides, coated silicas, or mixtures thereof, each in an amount of from about 0.1 to about 10, and more specifically from about 1 to about 3 weight percent of the obtained toner particles; a process wherein the polymer in the miniemulsion is of a diameter of from about 100 to about 1,000 nanometers, or wherein the polymer in the miniemulsion is of a diameter of from about 200 to about 600 nanometers; and a process for the preparation of toner which comprises aggregating individual encapsulated colorant miniemulsions, each containing water, a different colorant, polymer particles of, for example, a diameter of from about 100 to about 1,000 nanometers, an ionic surfactant, a cosurfactant, and a nonionic surfactant; and coalescing the aggregates generated.

With further respect to the present invention, there are generated encapsulated colorant particles by semicontinuous miniemulsion polymerization processes as illustrated herein, and wherein the mixing thereof of a number of individual encapsulated colorants are accomplished by heating to form latex aggregates of polymer encapsulated colorant particles, followed by coalescence to enable custom color toners with a high colorant loading of, for example, from about 10 to about 65, and more specifically from about 15 to about 45 percent by weight of the toner, and wherein the toner particles can be considered fine, that is for example, from about 2 to about 10 microns in volume average diameter.

In embodiments thereof, the present invention relates to a direct custom color toner process comprised of blending a number, such as from about 2 to about 10, of aqueous latex colorant dispersions, each containing, for example, monomer, a different pigment like cyan, magenta, yellow, green, and the like, such as HELIOGEN BLUE™ or HOSTAPERM PINK™, and a cationic surfactant, such as benzalkonium chloride (SANIZOL B-50), and wherein the latex miniemulsion contains an anionic surfactant, such as sodium dodecylbenzene sulfonate (for example NEOGEN R™ or NEOGEN SC™), sodium tetrapropyl diphenyloxide disulfonate (for example DOWFAX 2A1™) and cosurfactant, and wherein the latex polymer is derived from emulsion polymerization of the monomer selected, such as for example, styrene, acrylates, methacrylates, acrylonitrile, butadiene, acrylic acid, methacrylic acid, 2-carboxyethyl acrylate, and the like; mixing with heating to form a polymer shell encapsulating a colorant core, which on further stirring at a temperature of from about 35° C. to about 60° C., results in the formation of toner sized aggregates having an aggregate size of from about 2 microns to about 20 microns in volume average diameter as measured by the Coulter Counter (Microsizer II), and a particle size distribution of about 1.15 to about 1.35; thereafter, heating the aggregate suspension at from about 70° C. to about 95° C. to form toner particles; followed by filtration, washing, and drying in an oven, or the like, and then mixing each of the toners formed and processes for the preparation of toner compositions which comprise blending aqueous encapsulated latex colorant dispersion more specifically containing a pigment, such as carbon black, phthalocyanine, quinacridone or RHODAMINE B™ type red, green, brown, and the like with a cationic surfactant, such as benzalkonium chloride, wherein the latex is a minilatex emulsion derived from the emulsion polymerization of monomers selected from the group consisting of styrene, butadiene, acrylates, methacrylates, acrylonitrile, acrylic acid, methacrylic acid, 2-carboxyethyl acrylate, and the like, and which latex contains an anionic surfactant, such as sodium dodecylbenzene sulfonate or sodium tetrapropyl diphenyloxide disulfonate, a nonionic surfactant, and a cosurfactant, and which colorant encapsulated latex resin size is, for example, from about 100 to about 1,000 nanometers, and more specifically, from about 200 to about 600 nanometers as measured by light scattering technique on a Coulter N4 Plus Particle Sizer; heating the resulting flocculent mixture at a temperature below or about equal to the Tg of the polymer or resin formed in the latex, which heating is, for example, from about 30° C. to about 65° C. for an effective length of time of, for example, about 0.5 hour to about 2 hours to form toner sized aggregates; and subsequently heating the aggregate suspension at a temperature at or above the Tg of the latex polymer, for example from about 60° C. to about 100° C., to provide toner particles; and finally isolating the toner product by filtration, thereafter washing and drying in an oven, fluid bed dryer, freeze dryer, or spray dryer; whereby toner particles comprised of polymer, or resin, colorants, and optional toner additives can be obtained; each of the toners obtained can then be mixed at high shear, for example, in a polytron wherein the mixing blade speed is from about 5,000 to about 15,000 rpm, to provide a custom color toner; and a process for the preparation of custom color toner comprising (i) aggregating a latex polymer encapsulated primary colorant or primary colorant encapsulated polymer miniemulsion containing a primary colorant, such as yellow, cyan, magenta, or black, water, polymer, an ionic surfactant, a cosurfactant, and a nonionic surfactant, with a colorant dispersion;

(ii) coalescing or fusing the aggregates generated;

(iii) cooling, isolating, washing, and drying the toner;

(iv) admixing two or more primary toners from the above primary set using blending methods including, for example, ball milling, propeller type mixers, such as Logie or Lighnin, tumbling mixers and the like, to provide custom color toners, and wherein when blending, there can be selected at least two primary color toners prepared from pigment encapsulated latexes, and up to about 10, in ratios comprising at least 2 percent by weight of each toner, and more specifically at least 5 percent of each toner, and wherein the total amount is about 100 percent. Blending may be accomplished as illustrated herein, including sequentially, master batching, or splitting a large blended batch into two or more portions, some of which may undergo further blending with other toners. Also, with the present invention there is selected in embodiments a colorant encapsulated latex, more specifically, generated by a semicontinuous, miniemulsion polymerization process, followed by aggregation/coalescence of the colorant encapsulated polymer to enable toners with at least four different colors of cyan, yellow, magenta, and black color toners with uniform tribocharging wherein the difference in tribocharging among the different four color toners is, for example, less than about 10 $\mu$C/gram, and more specifically, less than about 5 $\mu$C/gram, such as from about 1 to about 5.

More specifically, with the present invention in embodiments thereof there is selected a semicontinuous, miniemulsion polymerization process to form latexes of encapsulated colorants. Generally, the process can be referred to as a miniemulsion polymerization, since the primary colorant particles are dispersed in a monomer or mixture of monomers, with polymerization subsequent to the emulsification. The miniemulsion process generates, for example, a water oil monomer emulsion wherein the amount of oil is from about 0.5 to about 80 weight percent, and more specifically, from about 5 to about 75 weight percent, and the amount of water is from about 20 to about 99.5 weight percent, and more specifically, from about 25 to about 95 weight percent, based on the total oil and water mixture. Subsequently, the resulting miniemulsion together with initiator can be continuously added at elevated temperature, for example temperatures of between about 35° C. to about 120° C., and more specifically, between about 45° C. to about 90° C. to accomplish the emulsion polymerization. The encapsulation of colorant particles with the miniemulsion polymerization process offers certain advantages over conventional methods such as the direct dispersion of the particles in the oil medium, rather than in the water phase, by using homogenization in the presence of surfactants. Homogenization is selected to provide the shear to generate the miniemulsion with the colorant particles located inside the miniemulsion droplets. The semicontinuous addition of a miniemulsion to a reactor can provide for the excellent stability of the miniemulsion preventing particle coalescence or flocculation among the interactive monomer emulsion droplets, and maintaining particle size in the range of from about 100 to about 1,000 nanometers, and more specifically, from about 200 to about 600 nanometers, and improved latex stability. The amount of colorant being encapsulated within the polymer is, for example, from about 80 to about 98 percent, based on the total amount of colorant selected for the preparation of the colorant encapsulated polymer particles.

Miniemulsions are, for example, relatively stable submicron, for example, about 100 to about 1,000, and more specifically, from about 100 to about 500 nanometer dispersions of oil (monomer) in water prepared by shearing a composition containing monomers, water, initiator, chain transfer agent, surfactant, cosurfactant, and additionally, colorant. A principle involved in the preparation of a stable miniemulsion, which stability can be maintained by using a cosurfactant to prevent or minimize particle coalescence or flocculation among the interactive monomer emulsion droplets, is the introduction of a low molecular weight cosurfactant, for example, the $M_w$ of the cosurfactant is about 5,000, more specifically not more than about 2,000, and still more specifically from about 100 to about 500, and which cosurfactant is a relatively highly water insoluble to the extent that in water it possesses a solubility of less than about $10^{-3}$ grams, more specifically less than about $10^{-4}$ grams, and more specifically from about $10^{-6}$ grams to about $10^{-4}$ grams per liter of water to substantially retard the diffusion of monomer and colorant out of the emulsion droplet. The cosurfactant can be comprised of, for example, a long chain alcohol or alkane of, for example, more specifically from about 12 to about 24 carbon atoms in length. The cosurfactant primarily functions to reduce the diffusion of monomer out of the monomer droplet, and more specifically, the cosurfactant can function to reduce the monomer diffusion to an extent of about 75 to about 95 percent to then enable relatively stable miniemulsions because, it is believed, of the formation of intermolecular complexes at the oil/water interface. The enhanced stability of miniemulsions is attributed to the formation of intermolecular complexes at the oil/water interface, which is comprised of solidified bilayers of anionic surfactant and cosurfactant separated by water. The macrostructure of the bilayers is comprised of a tortuous network of irregularly shaped aggregates with diameters between, for example, about 5 to about 100 nanometers. The complexes can be considered liquid condensed (the bilayer network separated by water) and the surface charge (zeta-potential) of the miniemulsions is, for example, from about 50 to about 120 mV, and more specifically, from about 60 to about 100 mV, as determined by the PenKem System 3000 Electrophoresis, electrically charged creating a low interfacial tension, for example, from about 0.5 dyne/centimeter to about 5 dyne/centimeter.

The polymer shell can be prepared by emulsion polymerization methods, and the monomers utilized in such processes include styrene, acrylates, methacrylates, butadienes, isoprenes, acrylic acids, methacrylic acids, acrylonitriles, and the like. Known chain transfer agents, for example dodecanethiol, about 0.1 to about 10 percent, or carbon tetrabromide in effective amounts, such as from about 0.1 to about 10 percent, can also be utilized to primarily control the molecular weight properties of the polymer when emulsion polymerization is selected. Other processes of obtaining polymer particles of from, for example, about 0.01 micron to about 5 microns in diameter can be selected, such as polymer microsuspension process, as disclosed in U.S. Pat. No. 3,674,736, the disclosure of which is totally incorporated herein by reference, polymer solution microsuspension process as disclosed in U.S. Pat. No. 5,290,654 the disclosure of which is totally incorporated herein by reference, mechanical grinding processes, or other known processes.

Long chain aliphatic mercaptans, such as dodecyl mercaptan, are commonly used as chain transfer agents to regulate the polymer molecular weight in emulsion polymerization. These surfactants are usually water-insoluble and could be used as hydrophobes to stabilize the miniemulsion droplets against monomer diffusion and colorant leaching. The miniemulsions stabilized with long chain aliphatic mercaptans are thermodynamically stable. These chain transfer agents may also function as cosurfactants.

Examples of ethylenically unsaturatedmonomers that can be selected for the processes of the present invention include, for example, vinyl aromatic and aliphatic hydrocarbons such as styrene, α-methyl styrene and similar substituted styrenes, vinyl naphthalene, vinyl toluene, divinyl benzene, and vinyl aliphatic hydrocarbons such as 1,3-butadiene, methyl-2-butadiene, 2,3-dimethyl butadiene, cyclopentadiene and dicyclopentadiene as well as ethylenically unsaturated esters, such as acrylic, methacrylic, cinnamic and crotonic and the like, and esters containing fumaric and maleic type unsaturation, and acid olefinic monomers, such as acrylic acid, methacrylic acid, itaconic acid, fumaric acid, maleic acid, 2-carboxyethyl acrylate, sodium acrylate, potassium acrylate, and the like. Particularly preferred monomers include, for example, styrene, 1,3-butadiene, isoprene, alkyl (meth)acrylates such as ethyl acrylate, butyl acrylate, methyl methacrylate, butyl methacrylate, acrylonitrile, vinyl acetate, acrylic acid, methacrylic acid, and 2-carboxyethyl acrylate.

Examples of the polymers formed from monomers after polymerization are poly(styrene-butadiene), poly (methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly (butyl acrylate-butadiene), poly(styrene-isoprene), poly (methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly (styrene-butyl acrylate), poly(styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), and poly(styrene-butyl acrylate-acrylononitrile-acrylic acid), poly(styrene-butadiene-2-carboxyethyl acrylate), poly(styrene-butadiene-acrylonitrile-2-carboxyethyl acrylate), poly(styrene-butyl acrylate-2-carbbxyethyl acrylate), and poly(styrene-butyl acrylate-acrylononitrile-2-carboxyethyl acrylate).

The free radical initiator utilized is generally an emulsion type water-soluble initiator, such as a persulfate like potassium, sodium, or ammonium persulfate, or oil-soluble initiators, such as benzyl peroxide, lauroyl peroxide, 2,2'-azobis(isobutyronitrile), or 2,2'-azobis-(2-methylbutyronitrile), or mixtures thereof. The free radical is selected in amounts of, for example, from about 0.1 to about 10 weight percent based on the total monomer or monomers used to prepare the polymer resin. Chain transfer agents selected include, for example, alkylthiol such as 1-dodecanethiol, in an amount of, for example, about 0.5 to about 10 percent on weight, halogenated carbons, such as carbon tetrabromide, about 0.1 to about 10 percent on weight, based on the monomer or monomers used to prepare the polymer resin, or more specifically an alkylthiol.

Cosurfactants include, for example, alkanes, and hydrocarbyl alcohols, ethers, amines, halides and esters, which are for example, inert, nonvolatile, water insoluble, liquids at a temperature of from about 40° C. to about 90° C., and contain a terminal aliphatic hydrocarbyl group, and mixtures thereof. The terminal aliphatic hydrocarbyl group of, for example, at least about 10, and more specifically, from about 10 to about 20 carbon atoms contained therein may be unsaturated, but is, more specifically, saturated, and branched, but is, more specifically, straight chain. The molecular weight $M_w$ of the cosurfactant is, for example, not more than about 5,000, more specifically, not more than about 2,000, and still more specifically, from about 100 to about 500. Examples of specific cosurfactants include alkanes, such as n-decane, n-tetradecane, n-hexadecane, n-octadecane, eicosane, tetracosane, 1-decene, 1-dodecene, 2-hexadecyne, 2-tetradecyne, 3-octyne, 4-octyne, and 1-tetradecane; alicyclic hydrocarbons, such as dodecyl cyclohexane; aromatic hydrocarbons, such as hexadecyl benzene; alcohols, such as decanol, lauryl alcohol, tetradecanol, cetyl alcohol, octadecanol, eicosanol, 1-heptadecanol and ceryl alcohol; hydrocarbyl alcohol esters of lower molecular weight carboxylic acids, such as cetyl acetate; ethers, such as octyl ether and cetyl ether; amines, such as tetradecyl amine, hexadecyl amine, and octadecyl amine; halides, such as hexadecyl chloride and other chlorinated paraffins; hydrocarbyl carboxylic acid esters of lower molecular weight alcohols, such as methyl, ethyl and isoamyl octanoate, methyl and octyl caprate, ethyl stearate, isopropyl myristate, methyl, isoamyl and butyl oleate, glyceryl tristearate, soybean oil, coconut oil, tallow, laurin, myristin, olein and the like. With the processes of the present invention, cosurfactants as illustrated herein are selected, such as more specifically cosurfactants of dodecane, hexadecane, lauryl alcohol, or cetyl alcohol, and which cosurfactants are selected in various suitable amounts, such as from about 0.005 to about 5, and more specifically, from about 0.5 to about 3 weight percent, or parts based on the monomer, or monomers used to prepare the polymer resin.

Various known colorants, such as pigments, present in the toner in a suitable amount of, for example, from about 1 to about 65 percent by weight of toner, and more specifically, in an amount of from about 2 to about 45 or about 2 to about 20, and in embodiments from about 2 to about 12 percent by weight, that can be selected include carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue, or mixtures thereof. Specific examples of pigments include phthalocyanine HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colored pigments that can be selected are cyan, magenta, red, brown, orange, or yellow pigments, and mixtures thereof. Examples of magentas that may be selected include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans that may be used include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like; while illustrative examples of yellows that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as pigments with the process of the present invention. Colorants include pigment, dye, mixtures of pigment and dyes, mixtures of pigments, mixtures of dyes, and the like. More specifically, pigment examples include Pigment Blue 15:3 having a Color Index Constitution Number of 74610, magenta pigment Red 81:3 having a Color Index Constitution Number of 45160:3, Yellow 17 having a Color Index Constitution Number of 21105, carbon black, and food dyes or other known suitable dyes. The colorants, pigment, dye or mixtures thereof selected are present in various effective amounts, such as from about 1 to about 65, and more specifically, from about 2 to about 45 weight percent of the toner.

Surfactants in effective amounts of, for example, 0.01 to about 15 weight percent of the reaction mixture in embodiments include, for example, nonionic surfactants, such as dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ in effective amounts of, for example, from about 0.1 to about 10 percent by weight of the reaction mixture; anionic surfactants such as, for example, sodium dodecylsulfate (SDS), sodium dodecylbenzene sulfonate, sodium tetrapropyl diphenyloxide disulfonate, sodium dodecylnaphthalene sulfate, dialkyl benzenealkyl sulfates and sulfonates, abitic acid, available from Aldrich, NEOGEN R™, NEOGEN SC™ obtained from Kao, DOWFAX 2A1™ obtained from Dow, and the like, in effective amounts of, for example, from about 0.01 to about 10 percent by weight; ionic surfactants, and more specifically, cationic surfactants, such as, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUA™ available from Alkaril Chemical Company, SANIZOL™ (benzalkonium chloride), available from Kao Chemicals, and the like, in effective amounts of, for example, from about 0.01 percent to about 10 percent by weight. More specifically, the molar ratio of the cationic surfactant used for flocculation to the anionic surfactant used in the latex preparation is in the range of from about 0.5 to about 4.

Examples of surfactants, which may be added, such as to the aggregates before coalescence is initiated, include anionic surfactants, such as sodium dodecylbenzene sulfonate, sodium dodecylnaphthalene sulfate, dialkyl benzenealkyl, sulfates and. sulfonates, abitic acid, available from Aldrich, NEOGEN R™, NEOGEN SC™ obtained from Kao, and the like. They can also be selected from nonionic surfactants, such as polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. An effective amount of the anionic or nonionic surfactant utilized in the coalescence to primarily stabilize the aggregate size against further growth with temperature is, for example, from about 0.01 to about 10 percent by weight, and more specifically from about 0.5 to about 5 percent by weight of monomers used to prepare the copolymer resin.

Surface additives that can be added to the toner compositions after washing or drying include, for example, metal salts, metal salts of fatty acids, colloidal silicas, mixtures thereof, and the like, which additives are usually present in an amount of from about 0.1 to about 2 weight percent, reference U.S. Pat. Nos. 3,590,000; 3,720,617; 3,655,374 and 3,983,045, and U.S. Pat. No. 6,190,815 and the applications recited therein, the disclosures of which are totally incorporated herein by reference. Preferred additives include zinc stearate and AEROSIL R972® available from Degussa in amounts of from about 0.1 to about 2 percent, which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. Also, there can be selected as carrier particles, or components a core with a coating thereover of polymethylmethacrylate with a conductive component dispersed therein, such as a conductive carbon black.

Imaging methods are also envisioned with the toners of the present invention, reference for example a number of the patents mentioned herein, and U.S. Pat. No. 4,265,990, the disclosure of which is totally incorporated herein by reference.

The following Examples are being submitted to further illustrate various species of the present invention. These Examples are intended to be illustrative only and are not intended to limit the scope of the present invention.

PREPARATION OF THE ENCAPSULATED PIGMENTS

Encapsulated Yellow Pigment Synthesis:

An encapsulated yellow pigment comprised of a yellow pigment core and a styrene/n-butyl acrylate/2-carboxyethyl acrylate terpolymer shell was synthesized by a semicontinuous, miniemulsion polymerization process. 1-Dodecanethiol, with a solubility in water of $3\times10^{-5}$ grams per liter of water at 25° C., was used as a cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), 1.9 grams of ANTAROX CA-897™ (70 percent active, octylphenol aromatic ethoxylate, Rhone-Poulenc), and 756 grams of deionized water were deaerated for 30 minutes while the temperature was raised to 80° C. A miniemulsion was prepared by homogenizing a monomer mixture (290 grams of styrene, 97 grams of n-butyl acrylate, 23.2 grams of 2-carboxyethyl acrylate, 1.9 grams of 2,2'-azobis(2-methylbutyronitrile), 15.5 grams of 1-dodecanethiol, and 33.5 grams of Yellow 17 pigment with an aqueous solution of 1.3 grams of DOWFAX 2A1™, 0.4 gram of ANTAROX CA-897™, 3.9 grams of ammonium persulfate, and 224 grams of deionized water via VirTishear Cyclone Homogenizer at 10,000 rpm for 30 minutes at room temperature, about 25° C. throughout. The resulting miniemulsion was fed into the above reactor over a period of 105 minutes. At the conclusion of the monomer feed, the emulsion was post-heated at 80° C. for 30 minutes, then there was added an initiator aqueous solution of 1.9 grams of ammonium persulfate and 20 grams of deionized water. After the above initiator addition was completed, the reaction was allowed to post react for 90 minutes at 80° C., then cooled to 25° C. The resulting encapsulated yellow pigment contained 28 percent solids comprised of poly (styrene-butyl acrylate-2-carboxyethyl acrylate) and Yellow Pigment 17, and possessed an average particle size of 395 nanometers as measured by light scattering technique on a Coulter N4 Plus Particle Sizer, and more specifically, the resulting product was comprised of about 92 percent of shell polymer of poly(styrene-butyl acrylate-2-carboxyethyl acrylate), and Yellow Pigment 17 core, about 8 percent by weight, wherein the polymer shell possessed an average thickness of about 85 nanometers, which was determined by transmission electron microscope image analysis of a thin section of the yellow pigment encapsulated latex. The shell polymer possessed an $M_w$ of 29,000, an $M_n$ of 6,200, both as determined on a Waters GPC, and a mid-point Tg of 52.6° C., as measured on a Seiko DSC.

Encapsulated Cyan Pigment Synthesis:

An encapsulated cyan pigment comprised of a cyan pigment core and a styrene/n-butyl acrylate/2-carboxyethyl acrylate terpolymer shell was synthesized by a semicontinuous, miniemulsion polymerization process. 1-Dodecanethiol, with a solubility in water of $3\times10^{-5}$ grams per liter of water at 25° C., was used (1-dodecanethiol has a dual function as a cosurfactant for the miniemulsion and as a primary chain transfer agent for polymer molecular weight regulation). In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), 1.9 grams of ANTAROX CA-897™ (70 percent active, octylphenol aromatic ethoxylate, Rhone-Poulenc), and 765 grams of deionized water were. deaerated for 30 minutes while the temperature was raised to 80° C. A miniemulsion was prepared by homogenizing a monomer mixture (303 grams of styrene, 101 grams of n-butyl acrylate, 24.3 grams of 2-carboxyethyl acrylate, 2 grams of 2,2'-azobis(2-methylbutyronitrile), 20.2 grams of 1-dodecanethiol, and 54.6 grams of cyan 15:3 pigment) with an aqueous solution (1.3 grams of DOWFAX 2A1™, 0.4 gram of ANTAROX CA-897™, 4.1 grams of ammonium persulfate, and 258 grams of deionized water) via VirTishear Cyclone Homogenizer at 10,000 rpm for 30 minutes at room temperature. The miniemulsion was fed into the reactor over 115 minutes. At the conclusion of the monomer feed, the emulsion was post-heated at 80° C. for 30 minutes, then there was added an initiator aqueous solution (2 grams of ammonium persulfate and 20 grams of deionized water). After the above initiator addition was completed, the reaction was allowed to post react for 90 minutes at 80° C., then cooled to 25° C. The resulting encapsulated cyan pigment contained 28 percent solids comprised of poly(styrene-butyl acrylate-2-carboxyethyl acrylate) and cyan pigment 15:3, and possessed an average particle size of 343 nanometers as measured by light scattering technique on a Coulter N4 Plus Particle Sizer. The resulting encapsulated product was comprised of about 96.3 percent of polymer, poly(styrene-butyl acrylate-2-carboxyethyl acrylate), and a core of the cyan pigment 15:3, about 3.7 percent by weight, and more specifically, the resulting encapsulated product was comprised of a cyan pigment core and a poly(styrene-butyl acrylate-2-carboxyethyl acrylate) polymer shell, wherein the polymer shell possessed an average thickness of about 95 nanometers as determined by transmission electron microscope image analysis. The polymer possessed an $M_w$ of 31,000, an $M_n$ of 7,400, both as determined on a Waters GPC, and a mid-point Tg of 51.4° C., as measured on a Seiko DSC.

Encapsulated Magenta Pigment Synthesis:

An encapsulated magenta pigment comprised of a magenta pigment core and a styrene/n-butyl acrylate/2-carboxyethyl acrylate terpolymer shell was synthesized by semicontinuous, miniemulsion polymerization process. 1-Dodecanethiol, with a solubility in water of $3\times10^{-5}$ grams per liter of water at 25° C., was selected as the cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), 1.9 grams of ANTAROX CA-897™ (70 percent active, octylphenol aromatic ethoxylate, Rhone-Poulenc), and 656 grams of deionized water were deaerated for 30 minutes while the temperature was raised to 80° C. A miniemulsion was prepared by homogenizing a monomer mixture (296 grams of styrene, 99 grams of n-butyl acrylate, 25 grams of 2-carboxyethyl acrylate, 2 grams of 2,2'-azobis(2-methylbutyronitrile), 9 grams of 1-dodecanethiol, and 25.2 grams of magenta 81.3 pigment) with an aqueous solution (1.3 grams of DOWFAX 2A1™, 0.4 gram of ANTAROX CA-897™, 4 grams of ammonium persulfate, and 224 grams of deionized water) via VirTishear Cyclone Homogenizer at 10,000 rpm for 30 minutes at room temperature. The miniemulsion was fed into the reactor over 180 minutes. At the conclusion of the monomer feed, the emulsion was post-heated at 80° C. for 30 minutes, followed by the addition of an initiator aqueous solution of 1.9 grams of ammonium persulfate and 20 grams of deionized water. After the above initiator addition was completed, the reaction was allowed to post react for 90 minutes at 80° C., then cooled to 25° C. The resulting encapsulated magenta pigment contained 26 percent solids comprised of poly(styrene-butyl acrylate-2-carboxyethyl acrylate) and magenta pigment 81.3, and possessed an average particle size of 493 nanometers as measured by light scattering technique on a Coulter N4 Plus Particle Sizer, and more specifically, the resulting encapsulated product was comprised of about 95 percent of shell polymer, poly (styrene-butyl acrylate-2-carboxyethyl acrylate), and magenta pigment 81.3, about 5 percent by weight, wherein the polymer shell possessed an average thickness of about 80 nanometers, as determined by transmission electron microscope image analysis of a thin section of the magenta pigment encapsulated latex. The polymer possessed an $M_w$ of 32,600, an $M_n$ of 6,400, as determined on a Waters GPC, and a mid-point Tg of 50.9° C., as measured on a Seiko DSC.

Encapsulated Black Piqment Synthesis:

An encapsulated black pigment comprised of a pigment core and a styrene/n-butyl acrylate/2-carboxyethyl acrylate terpolymer shell was synthesized by semicontinuous, miniemulsion polymerization process. 1-Dodecanethiol, with a solubility in water of $3\times10^{-5}$ grams per liter of water at 25° C., was used as a cosurfactant and as a primary chain transfer agent. In a 2 liter jacketed glass reactor with a stirrer set at 300 rpm, 5.3 grams of DOWFAX 2A1™ (sodium tetrapropyl diphenyloxide disulfonate, 47 percent active, Dow Chemical), 1.9 grams of ANTAROX CA-897™ (70 percent active, octylphenol aromatic ethoxylate, Rhone-Poulenc), and 656 grams of deionized water were deaerated for 30 minutes while the temperature was raised to 80° C. A miniemulsion was prepared by homogenizing a monomer mixture (296 grams of styrene, 99 grams of n-butyl acrylate, 24 grams of 2-carboxyethyl acrylate, 2 grams of 2,2'-azobis (2-methylbutyronitrile), 7 grams of 1-dodecanethiol, and 21.1 grams of REGAL 330® carbon black pigment) with an aqueous solution (1.3 grams of DOWFAX 2A1™, 0.4 gram of ANTAROX CA-897™, 4 grams of ammonium persulfate, and 227 grams of deionized water) via VirTishear Cyclone Homogenizer at 10,000 rpm for 30 minutes at room temperature. The miniemulsion was then fed into the reactor over 180 minutes. At the conclusion of the monomer feed, the emulsion was post-heated at 80° C. for 30 minutes, then there was added an initiator aqueous solution of 1.9 grams of ammonium persulfate and 20 grams of deionized water. After the above initiator addition was completed, the reaction was allowed to post react for 90 minutes at 80° C., then cooled to 25° C. The resulting encapsulated black product contained 27 percent solids, which was comprised of a shell of poly(styrene-butyl acrylate-2-carboxyethyl acrylate) and REGAL 330® carbon black pigment, which product possessed an average particle size of 239 nanometers as measured by light scattering technique on a Coulter N4 Plus Particle Sizer, and more specifically, the resulting encapsulated product was comprised of about 95 percent of polymer, poly(styrene-butyl acrylate-2-carboxyethyl acrylate), and REGAL 330® carbon black pigment, about 5 percent by weight, wherein the polymer shell possessed an average thickness of. about 65 nanometers, as determined by transmission electron microscope image analysis. The polymer possessed an $M_w$ of 29,500, an $M_n$ of 5,200, both as determined on a Waters GPC, and a mid-point Tg of 52.3° C., as measured on a Seiko DSC.

PREPARATION OF PRIMARY COLOR TONER PARTICLES

EXAMPLE I

Yellow Toner Particles:

370 Grams of the above prepared encapsulated yellow pigment, and 2.6 grams of cationic surfactant SANIZOL B-50™ were simultaneously added to 510 milliliters of water with high shear stirring at 7,000 rpm for 3 minutes, which stirring was accomplished by means of a polytron. The resulting mixture was then transferred to a 2 liter reaction vessel and heated at a temperature of 47° C. for 2 hours before 26 milliliters of 20 percent aqueous BIOSOFT D-40™ solution (sodium dodecyl benzene sulfonate) were added. Subsequently, the resulting mixture was heated to 93° C. and held there for a period of 4 hours before cooling down to room temperature, about 25° C. throughout, filtered, washed with water, and dried in a freeze dryer. The final toner product evidenced a particle size of 7.1 microns in volume average diameter with a particle size distribution of 1.18 as measured on a Coulter Counter. The resulting yellow toner was comprised of about 92 percent of the polymer poly(styrene-butyl acrylate-2-carboxyethyl acrylate), and Yellow Pigment Y-17, about 8 percent by weight of the toner, and wherein the total amount of the toner components was about 100 percent.

Toner Triboelectric Charge Evaluation:

In 120 milliliter glass bottles, 1 gram of the above prepared yellow toner was added to 24 grams of carrier particles comprised of 90 micron diameter ferrite core, spray coated with 0.5 weight percent of a terpolymer of poly (methyl methacrylate), styrene, and vinyltriethoxysilane with a coating weight of 1 percent. For each combination of toner and carrier, the above developer mixture was retained in an environmental chamber at either 20 percent relative humidity, 50 percent relative humidity, or 80 percent relative humidity overnight, about 16 hours. The bottles were then sealed, and the toner and carrier particles were mixed by roll milling for 30 minutes to obtain a stable triboelectric charge. The toner charge was measured using the standard Faraday Cage tribo blow-off apparatus.

Triboelectric charge evaluation indicated that the toner of this Example had a toner tribo of −35 $\mu$C/gram (microcoulombs per gram) at 20 percent relative humidity, −28 $\mu$C/gram at 50 percent relative humidity, and −13 $\mu$C/gram at 80 percent relative humidity.

EXAMPLE II

Cyan Toner Particles:

370 Grams of the above prepared encapsulated cyan pigment, and 2.3 grams of the cationic surfactant SANIZOL B-50™ were simultaneously added to 510 milliliters of water with high shear stirring at 7,000 rpm for 3 minutes by means of a polytron. The resulting mixture was then transferred to a 2 liter reaction vessel and heated at a temperature of 46° C. for 2 hours before 26 milliliters of 20 percent aqueous BIOSOFT D-40™ solution (sodium dodecyl benzene sulfonate, available from Stepan) were added. Subsequently, the mixture was heated to 93° C. and held there for a period of 4 hours before cooling down to room temperature, about 25° C. throughout, filtered, washed with water, and dried in a freeze dryer. The final toner product evidenced a particle size of 6.9 microns in volume average diameter with a particle size distribution of 1.19 as measured on a Coulter Counter. The resulting toner, that is the above final toner product, was comprised of about 96.3 percent of polymer, poly(styrene-butyl acrylate-2-carboxyethyl acrylate), and cyan pigment 15:3, about 3.7 percent by weight of toner. Triboelectric charge evaluation indicated that the toner of this Example had a toner tribo of −35 $\mu$C/gram (microcoulombs per gram) at 20 percent relative humidity, −27 $\mu$C/gram at 50 percent relative humidity, and 12 $\mu$C/gram at 80 percent relative humidity.

EXAMPLE III

Magenta Toner Particles:

400 Grams of the above prepared encapsulated magenta pigment, and 2.6 grams of cationic surfactant SANIZOL B-50™ were simultaneously added to 510 milliliters of water with high shear stirring at 7,000 rpm for 3 minutes by means of a polytron. The resulting mixture was then transferred to a 2 liter reaction vessel and heated at a temperature of 46° C. for 2 hours before 26 milliliters of 20 percent aqueous BIOSOFT D-40™ solution (sodium dodecyl benzene sulfonate, available from Stepan) were added. Subsequently, the mixture was heated to 93° C. and held there for a period of 4 hours before cooling down to room temperature, about 25° C. throughout, filtered, washed with water, and dried in a freeze dryer. The final toner product evidenced a particle size of 6.8 microns in volume average diameter with a particle size distribution of 1.24 as measured on a Coulter Counter. The resulting toner was comprised of about 95 percent of polymer, poly(styrene-butyl acrylate-2-carboxyethyl acrylate), and magenta pigment 81.3, about 5 percent by weight of toner. Triboelectric charge evaluation indicated that the toner of this Example had a toner tribo of −34 $\mu$C/gram (microcoulombs per gram) at 20 percent relative humidity, −28 $\mu$C/gram at 50 percent relative humidity, and −12 $\mu$C/gram at 80 percent relative humidity.

EXAMPLE IV

Black Toner Particles:

385 Grams of the above prepared black encapsulated pigment, and 2.6 grams of the cationic surfactant SANIZOL B-50™ were simultaneously added to 510 milliliters of water with high shear stirring at 7,000 rpm for 3 minutes by means of a polytron. The resulting mixture was then transferred to a 2 liter reaction vessel and heated at a temperature of 47° C. for 2 hours before 26 milliliters of 20 percent aqueous BIOSOFT D-40™ solution (sodium dodecyl benzene sulfonate, available from Stepan) were added. Subsequently, the mixture was heated to 93° C. and held there for a period of 4 hours before cooling down to room temperature, about 25° C. throughout, filtered, washed with water, and dried in a freeze dryer. The final toner product evidenced a particle size of 6.8 microns in volume average diameter with a particle size distribution of 1.20 as measured on a Coulter Counter. The resulting toner was comprised of about 95 percent of polymer, poly(styrene-butyl acrylate-2-carboxyethyl acrylate), and REGAL 330® carbon black pigment, about 5 percent by weight of toner. Triboelectric charge evaluation indicated that the toner of this Example had a toner tribo of −33 $\mu$C/gram (microcoulombs per gram) at 20 percent relative humidity, −26 $\mu$C/gram at 50 percent relative humidity, and −11 $\mu$C/gram at 80 percent relative humidity.

PREPARATION OF CUSTOM COLOR TONER PARTICLES

EXAMPLE V

Green Toner Particles:

185 Grams of the above prepared encapsulated yellow pigment dispersion, 185 grams of the above prepared encapsulated cyan pigment dispersion, and 2.6 grams of cationic surfactant SANIZOL B-50™ were simultaneously added to 510 milliliters of water with high shear stirring at 7,000 rpm for 3 minutes, which stirring was accomplished by means of a polytron. The resulting mixture was then transferred to a 2 liter reaction vessel and heated at a temperature of 48° C. for 2 hours before 26 milliliters of 20 percent aqueous BIOSOFT D-40™ solution (sodium dodecyl benzene sulfonate, available from Stepan) were added. Subsequently, the resulting mixture was. heated to 93° C. and held there for a period of 4 hours before cooling down to room temperature, about 25° C. throughout, filtered, washed with water, and dried in a freeze dryer. The final toner product evidenced a particle size of 6.8 microns in volume average diameter with a particle size distribution of 1.19 as measured on a Coulter Counter. The resulting green toner was comprised of about 94.1 percent of the polymer poly(styrene-butyl acrylate-2-carboxyethyl acrylate), about 4 percent of yellow pigment Y-17, and about 1.9 percent of cyan pigment 15:3, by weight of the toner. Triboelectric charge evaluation indicated that the toner of this Example had a toner tribo of −36 $\mu$C/gram (microcoulombs per gram) at 20 percent relative humidity, −28 $\mu$C/gram at 50 percent relative humidity, and −13 $\mu$C/gram at 80 percent relative humidity.

EXAMPLE VI

Orange Toner Particles:

247 Grams of the above encapsulated yellow pigment dispersion, 123 grams of the above encapsulated magenta pigment dispersion, and 2.6 grams of cationic surfactant SANIZOL B-50™ were simultaneously added to 510 milliliters of water with high shear stirring at 7,000 rpm for 3 minutes, which stirring was accomplished by means of a polytron. The resulting mixture was then transferred to a 2 liter reaction vessel and heated at a temperature of 47° C. for 2 hours before 26 milliliters of 20 percent aqueous BIOSOFT D-40™ solution were added. Subsequently, the resulting mixture was heated to 94° C. and held there for a period of 4 hours before cooling down to room temperature, about 25° C. throughout, filtered, washed with water, and dried in a freeze dryer. The final toner product evidenced a particle size of 6.7 microns in volume average diameter with a particle size distribution of 1.20 as measured on a Coulter Counter. The resulting orange toner was comprised of about 93 percent of the polymer poly(styrene-butyl acrylate-2-carboxyethyl acrylate), about 5.4 percent of Yellow Pigment Y-17, and about 1.6 percent of Magenta Pigment 81.3, by weight of the toner. Triboelectric charge evaluation indicated that the toner of this Example had a toner tribo of −34 $\mu$C/gram (microcoulombs per gram) at 20 percent relative humidity, −29 $\mu$C/gram at 50 percent relative humidity, and −13 $\mu$C/gram at 80 percent relative humidity.

EXAMPLE VII

Red Toner Particles:

153 Grams of the above prepared encapsulated yellow pigment dispersion, 207 grams of the above prepared encapsulated magenta pigment dispersion, and 2.6 grams of cationic surfactant SANIZOL B-50™ were simultaneously added to 510 milliliters of water with high shear stirring at 7,000 rpm for 3 minutes, which stirring was accomplished by means of a polytron. The resulting mixture was then transferred to a 2 liter reaction vessel and heated at a temperature of 47° C. for 2 hours before 26 milliliters of 20 percent aqueous BIOSOFT D-40™ solution were added. Subsequently, the resulting mixture was heated to 94° C. and held there for a period of 4 hours before cooling down to room temperature, about 25° C. throughout, filtered, washed with water, and dried in a freeze dryer. The final toner product evidenced a particle size of 6.8 microns in volume average diameter with a particle size distribution of 1.21 as measured on a Coulter Counter. The resulting red toner was comprised of about 93.7 percent of the polymer poly (styrene-butyl acrylate-2-carboxyethyl acrylate), about 3.5 percent of yellow pigment Y-17, and about 2.8 percent of magenta pigment 81.3, by weight of the toner. Triboelectric charge evaluation indicated that the toner of this Example had a toner tribo of −35 $\mu$C/gram (microcoulombs per gram) at 20 percent relative humidity, −28 $\mu$C/gram at 50 percent relative humidity, and −12 $\mu$C/gram at 80 percent relative humidity.

EXAMPLE VIII

Violet Toner Particles:

247 Grams of the above prepared encapsulated cyan pigment dispersion, 123 grams of the above prepared encapsulated magenta pigment dispersion, and 2.6 grams of cationic surfactant SANIZOL B-50™ were simultaneously added to 510 milliliters of water with high shear stirring at 7,000 rpm for 3 minutes, which stirring was accomplished by means of a polytron. The resulting mixture was then transferred to a 2 liter reaction vessel and heated at a temperature of 48° C. for 2 hours before 26 milliliters of 20 percent aqueous BIOSOFT D-40™ solution were added. Subsequently, the resulting mixture was heated to 94° C. and held there for a period of 4 hours before cooling down to room temperature, about 25° C. throughout, filtered, washed with water, and dried in a freeze dryer. The final toner product evidenced a particle size of 6.5 microns in volume average diameter with a particle size distribution of 1.18 as measured on a Coulter Counter. The resulting violet toner was comprised of about 95.9 percent of the polymer poly (styrene-butyl acrylate-2-carboxyethyl acrylate), about 2.5 percent of cyan pigment 15:3, and about 1.6 percent of magenta pigment 81.3, by weight of the toner. Triboelectric charge evaluation indicated that the toner of this Example had a toner tribo of −34 $\mu$C/gram (microcoulombs per gram) at 20 percent relative humidity, −27 $\mu$C/gram at 50 percent relative humidity, and −12 $\mu$C/gram at 80 percent relative humidity.

EXAMPLE IX

Purple Toner Particles:

123 Grams of the above prepared encapsulated cyan pigment dispersion, 247 grams of the above prepared encapsulated magenta pigment dispersion, and 2.6 grams of cationic surfactant SANIZOL B-50™ were simultaneously added to 510 milliliters of water with high shear stirring at 7,000 rpm for 3 minutes, which stirring was accomplished by means of a polytron. The resulting mixture was then transferred to a 2 liter reaction vessel and heated at a temperature of 48° C. for 2 hours before 26 milliliters of 20 percent aqueous BIOSOFT D-40™ solution were added. Subsequently, the resulting mixture was heated to 94° C. and held there for a period of 4 hours before cooling down to room temperature, about 25° C. throughout, filtered, washed with water, and dried in a freeze dryer. The final toner product evidenced a particle size of 6.5 microns in volume average diameter with a particle size distribution of 1.19 as measured on a Coulter Counter. The resulting purple toner was comprised of about 95.4 percent of the polymer poly (styrene-butyl acrylate-2-carboxyethyl acrylate), about 1.3 percent of cyan pigment 15:3, and about 3.3 percent of magenta pigment 81.3, by weight of the toner. Triboelectric charge evaluation indicated that the toner of this Example had a toner tribo of −34 μC/gram (microcoulombs per gram) at 20 percent relative humidity, −26 μC/gram at 50 percent relative humidity, and −11 μC/gram at 80 percent relative humidity.

EXAMPLE X

Brown Toner Particles:

258 Grams of the above prepared encapsulated yellow pigment dispersion, 86 grams of the above prepared encapsulated magenta pigment dispersion, 26 grams of the above encapsulated black pigment dispersion and 2.6 grams of cationic surfactant SANIZOL B-50™ were simultaneously added to 510 milliliters of water with high shear stirring at 7,000 rpm for 3 minutes, which stirring was accomplished by means of a polytron. The resulting mixture was then transferred to a 2 liter reaction vessel and heated at a temperature of 47° C. for 2 hours before 26 milliliters of 20 percent aqueous BIOSOFT D-40™ solution were added. Subsequently, the resulting mixture was heated to 94° C. and held there for a period of 4 hours before cooling down to room temperature, about 25° C. throughout, filtered, washed with water, and dried in a freeze dryer. The final toner product evidenced a particle size of 6.8 microns in volume average diameter with a particle size distribution of 1.22 as measured on a Coulter Counter. The resulting brown toner was comprised of about 92.8 percent of the polymer poly (styrene-butyl acrylate-2-carboxyethyl acrylate), about 5.7 percent of yellow pigment Y-17, about 1.1 percent of magenta pigment 81.3, and about 0.4 percent of carbon black pigment REGAL 330®, by weight of the toner. Triboelectric charge evaluation indicated that the toner of this Example had a toner tribo of −33 μC/gram (microcoulombs per gram) at 20 percent relative humidity, −27 μC/gram at 50 percent relative humidity, and −11 μC/gram at 80 percent relative humidity.

EXAMPLE XI

Lime Green Toner Particles:

123 Grams of the above prepared encapsulated yellow pigment dispersion, 123 grams of the above prepared encapsulated magenta pigment dispersion, 123 grams of the above encapsulated cyan pigment dispersion and 2.6 grams of cationic surfactant SANIZOL B-50™ were simultaneously added to 510 milliliters of water with high shear stirring at 7,000 rpm for 3 minutes, which stirring was accomplished by means of a polytron. The resulting mixture was then transferred to a 2 liter reaction vessel and heated at a temperature of 47° C. for 2 hours before 26 milliliters of 20 percent aqueous BIOSOFT D-40™ solution were added. Subsequently, the resulting mixture was heated to 94° C. and held there for a period of 4 hours before cooling down to room temperature, about 25° C. throughout, filtered, washed with water, and dried in a freeze dryer. The final toner product evidenced a particle size of 6.7 microns in volume average diameter with a particle size distribution of 1.21 as measured on a Coulter Counter. The resulting lime green toner was comprised of about 94.4 percent of the polymer poly(styrene-butyl acrylate-2-carboxyethyl acrylate), about 2.7 percent of yellow pigment Y-17, about 1.6 percent of magenta pigment 81.3, and about 1.3 percent of cyan pigment 15:3, by weight of the toner. Triboelectric charge evaluation indicated that the toner of this Example had a toner tribo of −35 μC/gram (microcoulombs per gram) at 20 percent relative humidity, −28 μC/gram at 50 percent relative humidity, and −13 μC/gram at 80 percent relative humidity.

EXAMPLE XII

Green Blended Toner Particles:

A green blended toner was prepared by mixing 52 grams of the yellow primary toner particles of Example I, and 52 grams of cyan primary toner particles of Example II, for 3 minutes at 3,000 rpm in a Lighnin' blender, then transferred to a 250 milliliter glass wide mouth bottle with a tight fitting lid, followed by rolling on a roll mill for 15 minutes at approximately 400 rpm in an atmosphere controlled to about 22° C. and 50 percent relative humidity. The final toner product evidenced a particle size of 7 microns in volume average diameter with a particle size distribution of 1.22 as measured on a Coulter Counter. The resulting green blended toner was comprised of about 94.1 percent of the polymer poly(styrene-butyl acrylate-2-carboxyethyl acrylate), about 4 percent of yellow pigment Y-17, and about 1.9 percent of cyan pigment 15:3, by weight of the toner. Triboelectric charge evaluation indicated that the toner of this Example had a toner tribo of −35 μC/gram (microcoulombs per gram) at 20 percent relative humidity, −27 μC/gram at 50 percent relative humidity, and −13 μC/gram at 80 percent relative humidity.

EXAMPLE XIII

Orange Blended Toner Particles:

A orange blended toner was prepared by mixing 69 grams of the yellow primary toner particles of Example I, and 32 grams of the magenta primary toner particles of Example III, for 3 minutes at 3,000 rpm in a Lighnin' blender, then transferred to a 250 milliliter glass wide mouth bottle with a tight fitting lid, and rolling on a roll mill for 15 minutes at approximately 400 rpm in an atmosphere controlled to about 22° C. and 50 percent relative humidity. The final toner product evidenced a particle size of 6.9 microns in volume average diameter with a particle size distribution of 1.23 as measured on a Coulter Counter. The resulting orange blended toner was comprised of about 93 percent of the polymer poly(styrene-butyl acrylate-2-carboxyethyl acrylate), about 5.4 percent of yellow pigment Y-17, and about 1.6 percent of magenta pigment 81.3, by weight of the toner. Triboelectric charge evaluation indicated that the toner of this Example had a toner tribo of −34 μC/gram (microcoulombs per gram) at 20 percent relative humidity, −26 μC/gram at 50 percent relative humidity, and −12 μC/gram at 80 percent relative humidity.

EXAMPLE XIV

Violet Blended Toner Particles:

A violet blended toner was prepared by mixing 69 grams of the cyan primary toner particles of Example II, and 32 grams of the magenta primary toner particles of Example III, for 3 minutes at 3,000 rpm in a Lighnin' blender, then transferred to a 250 milliliter glass wide mouth bottle with a tight fitting lid, and rolling on a roll mill for 15 minutes at approximately 400 rpm in an atmosphere controlled to about 22° C. and 50 percent relative humidity. The final toner product evidenced a particle size of 6.9 microns in volume average diameter with a particle size distribution of 1.21 as measured on a Coulter Counter. The resulting violet blended toner was comprised of about 95.9 percent of the polymer poly(styrene-butyl acrylate-2-carboxyethyl acrylate), about 2.5 percent of cyan pigment 15:3, and about 1.6 percent of magenta pigment 81.3, by weight of the toner. Triboelectric charge evaluation indicated that the toner of this Example had a toner tribo of −33 μC/gram (microcoulombs per gram) at 20 percent relative humidity, −27 μC/gram at 50 percent relative humidity, and −12 μC/gram at 80 percent relative humidity.

EXAMPLE XV

Purple Blended Toner Particles:

A purple blended toner was prepared by mixing 35 grams of the cyan primary toner particles of Example II, and 66 grams of magenta primary toner particles of Example III, for 3 minutes at 3,000 rpm in a Lighnin' blender, then transferred to a 250 milliliter glass wide mouth bottle with a tight fitting lid, and rolling on a roll mill for 15 minutes at approximately 400 rpm in an atmosphere controlled to about 22° C. and 50 percent relative humidity. The final toner product evidenced a particle size of 6.8 microns in volume average diameter with a particle size distribution of 1.22 as measured on a Coulter Counter. The resulting purple blended toner was comprised of about 95.4 percent of the polymer poly(styrene-butyl acrylate-2-carboxyethyl acrylate), about 1.3 percent of cyan pigment 15:3, and about 3.3 percent of magenta pigment 81.3, by weight of the toner. Triboelectric charge evaluation indicated that the toner of this Example had a toner tribo of −32 μC/gram (microcoulombs per gram) at 20 percent relative humidity, −28 μC/gram at 50 percent relative humidity, and −11 μC/gram at 80 percent relative humidity.

EXAMPLE XVI

Brown Blended Toner Particles:

A brown blended toner was prepared by mixing 72 grams of the yellow primary toner particles of Example I, 22 grams of the magenta primary toner particles of Example III, and 7 grams of black primary toner particles in Example IV, for 3 minutes at 3,000 rpm in a Lighnin' blender, then transferred to a 250 milliliter glass wide mouth bottle with a tight fitting lid, and rolling on a roll mill for 15 minutes at approximately 400 rpm in an atmosphere controlled to about 22° C. and 50 percent relative humidity. The final toner product evidenced a particle size of 7 microns in volume average diameter with a particle size distribution of 1.23 as measured on a Coulter Counter. The resulting brown blended toner was comprised of about 92.8 percent of the polymer poly(styrene-butyl acrylate-2-carboxyethyl acrylate), about 5.7 percent of yellow pigment Y-17, about 1.1 percent of magenta pigment 81.3, and about 0.4 percent of carbon black pigment REGAL 330®, by weight of the toner. Triboelectric charge evaluation indicated that the toner of this Example had a toner tribo of −34 μC/gram (microcoulombs per gram) at 20 percent relative humidity, −25 μC/gram at 50 percent relative humidity, and −12 μC/gram at 80 percent relative humidity.

EXAMPLE XVII

Lime Green Blended Toner Particles:

A lime green blended toner was prepared by mixing 34 grams of the yellow primary toner particles of Example I, 34 grams of the cyan primary toner particles of Example II, and 32 grams of the magenta primary toner particles of Example III, for 3 minutes at 3,000 rpm in a Lighnin' blender, then transferred to a 250 milliliter glass wide mouth bottle with a tight fitting lid, and rolling on a roll mill for 15 minutes at approximately 400 rpm in an atmosphere controlled to about 22° C. and 50 percent relative humidity. The final toner product evidenced a particle size of 6.9 microns in volume average diameter with a particle size distribution of 1.21 as measured on a Coulter Counter. The resulting lime green blended toner was comprised of about 94.4 percent of the polymer poly(styrene-butyl acrylate-2-carboxyethyl acrylate), about 2.7 percent of yellow pigment Y-17, about 1.6 percent of magenta pigment 81.3, and about 1.3 percent of cyan pigment 15:3, by weight of the toner. Triboelectric charge evaluation indicated that the toner of this Example had a toner tribo of −33 μC/gram (microcoulombs per gram) at 20 percent relative humidity, −27 μC/gram at 50 percent relative humidity, and −11 μC/gram at 80 percent relative humidity.

COMPARATIVE EXAMPLES I to VI

Polymer Latex Synthesis:

A latex was prepared by the semicontinuous emulsion polymerization of styrene/butyl acrylate/2-carboxyethyl acrylate, 75/25/6 parts (by weight), as follows. A 2 liter jacketed glass flask with a stirrer set at 200 rpm, and containing 8.8 grams of DOWFAX 2A1™ (sodium tetrapropyl diphenyloxide disulfonate, 47 percent active, available from Dow Chemical), 3 grams of polyoxyethylene nonyl phenyl ether nonionic surfactant, ANTAROX CA 897™ (70 percent active, octylphenol aromatic ethoxylate, Rhone-Poulenc), and 519 grams of deionized water were purged with nitrogen for 30 minutes while the temperature was from about 25° C. to about 80° C. A monomer emulsion was prepared by homogenizing a monomer mixture (405 grams of styrene, 135 grams of n-butyl acrylate, 32.4 grams of 2-carboxyethyl acrylate, and 7.1 grams of 1-dodecanethiol) with an aqueous solution (4.4 grams of DOWFAX 2A1™, 1.5 grams of ANTAROX CA-897™, and 251 grams of deionized water) at 10,000 rpm for 5 minutes at room temperature of about 25° C. via VirTishear Cyclone Homogenizer. Forty one (41) grams of seed were removed from the monomer emulsion and added into the flask, and the flask contents were stirred for 5 minutes at 80° C. An initiator solution prepared from 8.1 grams of ammonium persulfate in 40 grams of deionized water was added to the flask mixture over 20 minutes. Stirring was continued for an additional 20 minutes to allow a seed particle formation. The remaining 795 grams of monomer emulsion were fed continuously into the reactor over 4 hours and 20 minutes. The nitrogen purge was reduced to a slow trickle to maintain a small positive pressure. After the above monomer emulsion addition was completed, the reaction was allowed to post react for 90 minutes at 80° C., then cooled to 25° C. by cool water. The resulting polymer of poly(styrene-butyl acrylate-acrylic acid-2-carboxyethyl acrylate) polymer possessed an $M_w$ of 31,200, and an $M_n$ of 8,400, as determined on a Waters GPC, and a mid-point Tg of 52° C., as measured on a Seiko DSC. The latex monomer possessed a volume average diameter of 202 nanometers as measured by light scattering technique on a Coulter N4 Plus Particle Sizer.

COMPARATIVE EXAMPLE I

Yellow Toner Particles Prepared bv Aggregation of Polymer Latex and Yellow Pigment Dispersion:

260 Grams of the above prepared latex emulsion of Comparative Example I and 220 grams of an aqueous yellow pigment dispersion containing 45 grams of yellow pigment Y-17 (21 percent solids), and 2.6 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 26 milliliters of 20 percent aqueous BIOSOFT D-40™ solution were added. Aggregates with a particle size (volume average diameter) of 6.3 microns with a GSD=1.20, as measured on the Coulter Counter, were obtained. Subsequently, the mixture was heated to 93° C. and held there for a period of 4 hours before cooling down to room temperature, about 25° C. throughout, filtered, washed with water, and dried in a freeze dryer. The final toner product evidenced a particle size of 7 microns in volume average diameter with a particle size distribution of 1.21 as measured on a Coulter Counter.

The resulting toner was comprised of about 92 percent of the polymer poly(styrene-butyl acrylate-2-carboxyethyl acrylate), and yellow pigment Y-17, about 8 percent by weight of toner, with a toner volume average diameter of 7 microns and a GSD of 1.21.

Triboelectric charge evaluation indicated that the toner of this Comparative Example had an unstable toner tribo of −45 μC/gram (microcoulombs per gram) at 20 percent relative humidity, −35 μC/gram at 50 percent relative humidity, and −10 μC/gram at 80 percent relative humidity.

COMPARATIVE EXAMPLE II

Cyan Toner Particles Prepared by Aggregation of Polymer Latex and Cyan Pigment Dispersion:

260 Grams of the above prepared latex emulsion of Comparative Example I and 220 grams of an aqueous cyan pigment dispersion containing 7.6 grams of cyan pigment 15:3 (53 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1 hour before 26 milliliters of 20 percent an aqueous surfactant BIOSOFT D-40™ solution were added. Aggregates with a particle size (volume average diameter) of 6.7 microns with a GSD=1.17, as measured on the Coulter Counter, were obtained. Subsequently, the mixture was heated to 93° C. and held there for a period of 2.5 hours before cooling down to room temperature, about 25° C. throughout, filtered, washed with water, and dried in a freeze dryer. The final toner product evidenced a particle size of 7 microns in volume average diameter with a particle size distribution of 1.24 as measured on a Coulter Counter.

The resulting toner was comprised of about 96 percent of the above prepared polymer poly(styrene-butyl acrylate-2-carboxyethyl acrylate), and cyan pigment 15:3, about 4 percent by weight of toner, and which toner possessed a volume average diameter of 7 microns and a GSD of 1.24.

Triboelectric charge evaluation indicated that the toner of this Comparative Example had a toner tribo of −36 μC/gram (microcoulombs per gram) at 20 percent relative humidity, −28 μC/gram at 50 percent relative humidity, and −16 μC/gram at 80 percent relative humidity.

COMPARATIVE EXAMPLE III

Magenta Toner Particles Prepared by Aggregation of Polymer Latex and Magenta Pigment Dispersion:

260 Grams of the above prepared latex emulsion of Comparative Example I and 220 grams of an aqueous magenta pigment dispersion containing 24 grams of magenta pigment 81.3 (21 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1 hour before 26 milliliters of 20 percent aqueous BIOSOFT D-40™ solution were added. Aggregates with a particle size (volume average diameter) of 6.6 microns with a GSD=1.17, as measured on the Coulter Counter, were obtained. Subsequently, the mixture was heated to 93° C. and held there for a period of 4 hours before cooling down to room temperature, about 25° C. throughout, filtered, washed with water, and dried in a freeze dryer. The final toner product evidenced a particle size of 7.1 microns in volume average diameter with a particle size distribution of 1.24 as measured on a Coulter Counter.

The resulting toner was comprised of about 95 percent of polymer, poly(styrene-butyl acrylate-2-carboxyethyl acrylate), and Magenta Pigment 81.3, about 5 percent by weight of toner, with a volume average diameter of 7.1 microns and a GSD of 1.24.

Triboelectric charge evaluation indicated that the toner of this Comparative Example had a toner tribo of −33 μC/gram (microcoulombs per gram) at 20 percent relative humidity, −24 μC/gram at 50 percent relative humidity, and −7 μC/gram at 80 percent relative humidity.

COMPARATIVE EXAMPLE IV

Green Toner Particles Prepared by Aggregation of Polymer Latex and Yellow and Cyan Pigment Dispersions:

260 Grams of the above prepared latex emulsion of Comparative Example I and 220 grams of an aqueous pigment dispersion containing 20 grams of yellow pigment Y-17 (21 percent solids), and 3.7 grams of cyan pigment 15:3 (53 percent solids), and 2.6 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1.5 hours before 26 milliliters of 20 percent aqueous BIOSOFT D-40™ solution were added. Aggregates with a particle size (volume average diameter) of 6.5 microns with a GSD=1.27, as measured on the Coulter Counter, were obtained. Subsequently, the mixture was heated to 93° C. and held there for a period of 4 hours before cooling down to room temperature, about 25° C. throughout, filtered, washed with water, and dried in a freeze dryer. The final toner product evidenced a particle size of 7.1 microns in volume average diameter with a particle size distribution of 1.28 as measured on a Coulter Counter.

The resulting toner was comprised of about 94.2 percent of the polymer poly(styrene-butyl acrylate-2-carboxyethyl acrylate), about 3.9 percent of yellow pigment Y-17, and about 1.9 percent of cyan pigment 15:3, by weight of the toner, with an volume average diameter of 7.1 microns and a GSD of 1.28.

Triboelectric charge evaluation indicated that the toner of this Comparative Example had a toner tribo of −50 μC/gram (microcoulombs per gram) at 20 percent relative humidity, −30 μC/gram at 50 percent relative humidity, and −8 μC/gram at 80 percent relative humidity.

COMPARATIVE EXAMPLE V

Orange Toner Particles Prepared by Aggregation of Polymer Latex and Yellow and Magenta Pigment Dispersions:

260 Grams of the above prepared latex emulsion of Comparative Example I and 220 grams of an aqueous cyan pigment dispersion containing 28 grams of yellow pigment Y-17 (21 percent solids) and 8 grams of magenta pigment 81.3 (21 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1 hour before 26 milliliters of 20 percent an aqueous surfactant BIOSOFT D-40™ solution were added. Aggregates with a particle size (volume average diameter) of 6.7 microns with a GSD=1.19, as measured on the Coulter Counter, were obtained. Subsequently, the mixture was heated to 93° C. and held there for a period of 2.5 hours before cooling down to room temperature, about 25° C. throughout, filtered, washed with water, and dried in a freeze dryer. The final toner product evidenced a particle size of 6.9 microns in volume average diameter with a particle size distribution of 1.31 as measured on a Coulter Counter.

The resulting toner was comprised of about 93 percent of the above prepared polymer poly(styrene-butyl acrylate-2-carboxyethyl acrylate), about 5.5 percent of yellow pigment Y-17, and about 1.5 percent of magenta pigment 81.3, by weight of the toner, and which toner possessed a volume average diameter of 6.9 microns and a GSD of 1.31.

Triboelectric charge evaluation indicated that the toner of this Comparative Example had a toner tribo of −28 μC/gram (microcoulombs per gram) at 20 percent relative humidity, −22 μC/gram at 50 percent relative humidity, and −6 μC/gram at 80 percent relative humidity.

COMPARATIVE EXAMPLE VI

Violet Toner Particles Prepared bv Aggregation of Polymer Latex and Magenta and Cyan Pigment Dispersions:

260 Grams of the above prepared latex emulsion of Comparative Example I and 220 grams of an aqueous magenta pigment dispersion containing 5 grams of cyan pigment 15:3 (53 percent solids), 8 grams of magenta pigment 81.3 (21 percent solids), and 2.3 grams of cationic surfactant SANIZOL B-50™ were simultaneously added to 400 milliliters of water with high shear stirring at 7,000 rpm for 3 minutes by means of a polytron. The resulting mixture was then transferred to a 2 liter reaction vessel and heated at a temperature of 48° C. for 1 hour before 26 milliliters of 20 percent aqueous BIOSOFT D-40™ solution were added. Aggregates with a particle size (volume average diameter) of 6.5 microns with a GSD=1.19, as measured on the Coulter Counter, were obtained. Subsequently, the mixture was heated to 93° C. and held there for a period of 4 hours before cooling down to room temperature, about 25° C. throughout, filtered, washed with water, and dried in a freeze dryer. The final toner product evidenced a particle size of 7.1 microns in volume average diameter with a particle size distribution of 1.34 as measured on a Coulter Counter. The resulting toner was comprised of about 95.9 percent of polymer, poly(styrene-butyl acrylate-2-carboxyethyl acrylate), about 2.6 percent of cyan pigment 15:3, and about 1.5 percent of magenta pigment 81.3, by weight of the toner, with a volume average diameter of 7.1 microns and a GSD of 1.34.

Triboelectric charge evaluation indicated that the toner of this Comparative Example had a toner tribo of −30 μC/gram (microcoulombs per gram) at 20 percent relative humidity, −19 μC/gram at 50 percent relative humidity, and −10 μC/gram at 80 percent relative humidity.

COMPARATIVE EXAMPLE VII

Green Blended Toner Particles:

A green blended toner was prepared by mixing 52 grams of yellow primary toner particles in Comparative Example I, and 52 grams of cyan primary toner particles in Comparative Example II, for 3 minutes at 3,000 rpm in a Lighnin' blender, then transferred to a 250 milliliter glass wide mouth bottle with a tight fitting lid, and rolling on a roll mill for 15 minutes at approximately 400 rpm in an atmosphere controlled to about 22° C. and 50 percent relative humidity. The final toner product evidenced a particle size of 7 microns in volume average diameter with a particle size distribution of 1.32 as measured on a Coulter Counter. The resulting green blended toner was comprised of about 94.1 percent of the polymer poly(styrene-butyl acrylate-2-carboxyethyl acrylate), about 4 percent of yellow pigment Y-17, and about 1.9 percent of cyan pigment 15:3, by weight of the toner. Triboelectric charge evaluation indicated that the toner of this Example had a toner tribo of −52 μC/gram (microcoulombs per gram) at 20 percent relative humidity, −33 μC/gram at 50 percent relative humidity, and −11 μgC/gram at 80 percent relative humidity.

COMPARATIVE EXAMPLE VIII

Orange Blended Toner Particles:

A orange blended toner was prepared by mixing 69 grams of yellow primary toner particles in Comparative Example I, and 32 grams of cyan primary toner particles in Comparative Example III, for 3 minutes at 3,000 rpm in a Lighnin' blender, then transferred to a 250 milliliter glass wide mouth bottle with a tight fitting lid, and rolling on a roll mill for 15 minutes at approximately 400 rpm in an atmosphere controlled to about 22° C. and 50 percent relative humidity. The final toner product evidenced a particle size of 6.9 microns in volume average diameter with a particle size distribution of 1.33 as measured on a Coulter Counter. The resulting orange blended toner was comprised of about 93 percent of the polymer poly(styrene-butyl acrylate-2-carboxyethyl acrylate), about 5.4 percent of yellow pigment Y-17, and about 1.6 percent of magenta pigment 81.3, by weight of the toner. Triboelectric charge evaluation indicated that the toner of this Example had a toner tribo of −30 μC/gram (microcoulombs per gram) at 20 percent relative humidity, −23 μC/gram at 50 percent relative humidity, and −6 μC/gram at 80 percent relative humidity.

COMPARATIVE EXAMPLE IX

Violet Blended Toner Particles:

A violet blended toner was prepared by mixing 69 grams of cyan primary toner particles in Comparative Example II, and 32 grams of cyan primary toner particles in Comparative Example III, for 3 minutes at 3,000 rpm in a Lighnin' blender, then transferred to a 250 milliliter glass wide mouth bottle with a tight fitting lid, and rolling on a roll mill for 15 minutes at approximately 400 rpm in an atmosphere controlled to about 22° C. and 50 percent relative humidity. The final toner product evidenced a particle size of 6.9 microns in volume average diameter with a particle size distribution of 1.31 as measured on a Coulter Counter. The resulting violet blended toner was comprised of about 95.9 percent of the polymer poly(styrene-butyl acrylate-2-carboxyethyl acrylate), about 2.5 percent of cyan pigment 15:3, and about 1.6 percent of magenta pigment 81.3, by weight of the toner. Triboelectric charge evaluation indicated that the toner of this Example had a toner tribo of −28 μ/gram (microcoulombs per gram) at 20 percent relative humidity, −20 μC/gram at 50 percent relative humidity, and −8 μC/gram at 80 percent relative humidity.

The triboelectric charge evaluation at different relative humidity (RH) of the toners of Examples I to IX, and Comparative Examples I to VI is summarized in Table 1. As indicated in the table, it was found that the primary color and custom color toner particles generated with encapsulated pigment latexes possessed substantially uniform triboelectric toner charging, wherein the difference in tribocharging among different color toners in different relative humilities was only about 2 to about 3 μC/gram. This indicates passivation of triboelectric properties of the pigment by the encapsulating shell. In Comparative Examples I to VI, the difference in tribocharging among different color toners is from about 9 to about 22 μC/gram. Therefore, the encapsulated pigments of the present invention can provide uniform tribo charge for yellow, cyan, magenta, and black primary color toners, and green, orange, red, violet, purple, brown and lime green custom color toners, and result in toners with similar charging behavior independent of the colorant or pigment type selected.

Table 2 summarizes the triboelectric charge evaluation at different relative humidities (RH) of toner blends of the primary color toners of Examples I to IV, and the toner blends of the primary color toners of Comparative Examples I to III. As indicated in this table, it was found that both the individual toners and the blended toners generated with encapsulated pigment latexes possessed substantially uniform triboelectric toner charging, wherein the difference in tribocharging among different color toners in different relative humilities was only about 2 to about 3 $\mu$C/gram. This indicates passivation of triboelectric properties of the pigment by the encapsulating shell. In Comparative Examples I to III, and VII to IX, the difference in tribocharging among different color toners is from about 10 to about 24 $\mu$C/gram. Thus, the encapsulated pigments of the present invention can provide uniform tribo charge for yellow, cyan, magenta, and black primary color toners, and green, orange, red, violet, purple, brown and lime green blended custom color toners, and result in toners with similar charging behavior independent of the colorant or pigment type selected.

TABLE 1

Tribocharge Evaluation of Custom Color Toner Particles

| Example | Color | Q/M ($\mu$C/gram) @ 60° F./20% RH | Q/M ($\mu$C/gram) @ 70° F./50% RH | Q/M ($\mu$C/gram) @ 80° F./80% RH |
|---|---|---|---|---|
| I | Yellow | −35 | −28 | −13 |
| II | Cyan | −35 | −27 | −12 |
| III | Magenta | −34 | −28 | −12 |
| IV | Black | −33 | −26 | −11 |
| V | Green | −36 | −28 | −13 |
| VI | Orange | −34 | −29 | −13 |
| VII | Red | −35 | −28 | −12 |
| VIII | Violet | −34 | −27 | −12 |
| IX | Purple | −34 | −26 | −11 |
| X | Brown | −33 | −27 | −11 |
| XI | Lime Green | −35 | −28 | −13 |
| Comparative I | Yellow | −42 | −35 | −10 |
| Comparative II | Cyan | −36 | −28 | −16 |
| Comparative III | Magenta | −33 | −24 | −7 |
| Comparative IV | Green | −50 | −30 | −8 |
| Comparative V | Orange | −28 | −22 | −6 |
| Comparative VI | Violet | −30 | −19 | −10 |

TABLE 2

Tribocharge Evaluation of Blended Custom Color Toner Particles

| Example/ Composition | Color | Q/M ($\mu$C/ gram) @ 60° F./ 20% RH | Q/M ($\mu$C/ gram) @ 70° F./ 50% RH | Q/M ($\mu$C/ gram) @ 80° F./ 80% RH |
|---|---|---|---|---|
| I | Yellow | −35 | −28 | −13 |
| II | Cyan | −35 | −27 | −12 |
| III | Magenta | −34 | −28 | −12 |
| IV | Black | −33 | −26 | −11 |
| XII (50% I + 50% II) | Green | −35 | −27 | −13 |
| XIII (68% I + 32% III) | Orange | −34 | −26 | −12 |
| XIV (68% II + 32% III) | Violet | −33 | −27 | −12 |

TABLE 2-continued

Tribocharge Evaluation of Blended Custom Color Toner Particles

| Example/ Composition | Color | Q/M ($\mu$C/ gram) @ 60° F./ 20% RH | Q/M ($\mu$C/ gram) @ 70° F./ 50% RH | Q/M ($\mu$C/ gram) @ 80° F./ 80% RH |
|---|---|---|---|---|
| XV (35% II + 65% III) | Purple | −32 | −28 | −11 |
| XVI (71% I + 22% III + 7% IV) | Brown | −34 | −25 | −12 |
| XVII (34% I + 34% II + 32% III) | Lime Green | −33 | −27 | −11 |
| Comparative I | Yellow | −45 | −35 | −10 |
| Comparative II | Cyan | −36 | −28 | −16 |
| Comparative III | Magenta | −33 | −24 | −7 |
| Comparative VII (50% Comparative I + 50% Comparative II) | Green | −52 | −33 | −11 |
| Comparative VIII (68% Comparative I + 32% Comparative III) | Orange | −30 | −23 | −6 |
| Comparative IX (68% Comparative II + 32% Comparative III) | Violet | −28 | −20 | −8 |

In embodiments, as indicated herein custom colored toners can be obtained by preparing primary color pigment or dye encapsulated latexes, such as cyan, magenta, yellow, and black, via a miniemulsion polymerization process, followed by aggregation/coalescence of a combination of the pigment or dye encapsulated latexes in appropriate known amounts to achieve a preselected colored toner; and blended custom colored toners can be obtained by admixing at least two primary color toners, wherein each toner is prepared by aggregation/coalescence of primary color pigment encapsulated latexes, such as cyan, magenta, yellow, and black via a miniemulsion polymerization process.

Other embodiments and modifications of the present invention may occur to those skilled in the art subsequent to a review of the information presented herein; these embodiments and modifications, equivalents thereof, substantial equivalents thereof, or similar equivalents thereof are also included within the scope of this invention.

What is claimed is:

1. A process for the preparation of toner which comprises (1) aggregating and coalescing in the presence of a coagulant an encapsulated colorant, and (2) blending with at least one toner.

2. A process in accordance with claim 1 wherein said toner is formed by aggregating and coalescing in the presence of an ionic surfactant an encapsulant colorant latex, and wherein said encapsulated colorant is comprised of a colorant core and a polymer coating.

3. A process in accordance with claim 1 wherein at least one is from one to about seven.

4. A process in accordance with claim 1 wherein at least one is from one to about four.

5. A process in accordance with claim 1 wherein aggregating and coalescing is accomplished in the presence of heat, and said encapsulated colorant contains a polymer coating.

6. A process in accordance with claim 1 wherein said aggregating is accomplished in the presence of heat, and which heat is at a temperature below the glass transition temperature of polymer of said encapsulated colorant.

7. A process in accordance with claim 5 wherein said aggregating is accomplished in the presence of heat and which heat is at a temperature above the glass transition temperature of polymer.

8. A process in accordance with claim 1 wherein said encapsulated colorant is comprised of a colorant core and a polymer shell.

9. A process in accordance with claim 8 wherein said colorant is magenta, cyan, yellow, black, or mixtures thereof.

10. A process in accordance with claim 1 wherein (1) is repeated, and wherein said colorant for each encapsulated colorant is dissimilar.

11. A process in accordance with claim 1 wherein (1) is repeated from for about two to about five times, and wherein said encapsulated colorant is generated by a miniemulsion process.

12. A process in accordance with claim 8 wherein (1) is repeated and wherein said colorant for each encapsulated colorant is dissimilar.

13. A process in accordance with claim 12 wherein one colorant is cyan, one colorant is magenta, and one colorant is yellow.

14. A process in accordance with claim 12 wherein one colorant is cyan, one is magenta, one is yellow, and one is black.

15. A process in accordance with claim 1 wherein one colorant is cyan, one is magenta, one is yellow, and one is black, or mixtures thereof.

16. A process in accordance with claim 1 wherein said encapsulated colorant latex is generated by miniemulsion polymerization.

17. A process in accordance with claim 6 wherein said temperature below the glass transition temperature is from about 35° C. to about 55° C., and the temperature above the glass transition temperature is from about 70° C. to about 95° C., and wherein the final toner size is from about 2 to about 20 microns in volume average diameter.

18. A process in accordance with claim 1 wherein said coagulant is a cationic surfactant.

19. A process in accordance with claim 18 wherein said surfactant is a dialkylbenzene dialkylammonium chloride.

20. A process in accordance with claim 1 wherein said coagulant is selected in an amount of from about 0.5 to about 10 weight percent.

21. A process in accordance with claim 1 wherein said toner product is comprised of polymer and colorant.

22. A process in accordance with claim 1 wherein said encapsulated colorant is comprised of colorant, polymer, and a water media, and which colorant is encapsulated in a polymer.

23. A process in accordance with claim 6 wherein said polymer is selected from the group consisting of poly (styrene-butadiene), poly(methylstyrene-butadiene), poly (methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), and poly(butyl acrylate-isoprene); poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylononitrile-acrylic acid), poly(styrene-butadiene-2-carboxyethyl acrylate), poly(styrene-butadiene-acrylonitrile-2-carboxyethyl acrylate), poly(styrene-butyl acrylate-2-carboxyethyl acrylate), and poly(styrene-butyl acrylate-acrylononitrile-2-carboxyethyl acrylate).

24. A process in accordance with claim 1 wherein said coagulant is a quaternary ammonium salt.

25. A process which comprises mixing, aggregating and coalescing an encapsulated colorant in the presence of a coagulant; separately repeating said mixing, aggregating and coalescing, and thereafter blending each of said toners obtained, and wherein said encapsulated colorant is comprised of colorant and polymer.

26. A process in accordance with claim 25 wherein said repeating is accomplished for from about 2 to about 5 times.

27. A process in accordance with claim 1 wherein said coagulant is an ionic surfactant.

28. A process in accordance with claim 1 wherein said coagulant is a cationic surfactant.

29. A process in accordance with claim 1 further including adding a cosurfactant.

30. A toner process comprising (1) aggregating and coalescing in the presence of a coagulant an encapsulated colorant, and (2) blending with at least one toner; and wherein said aggregating and coalescence is accomplished by a first and second heating wherein the first heating is at a temperature lower than said second heating.

* * * * *